US008068080B2

(12) United States Patent
Nishimura

(10) Patent No.: US 8,068,080 B2
(45) Date of Patent: Nov. 29, 2011

(54) DISPLAY APPARATUS, SOURCE DRIVER, AND DISPLAY PANEL DRIVING METHOD

(75) Inventor: Kouichi Nishimura, Kanagawa (JP)

(73) Assignee: Renesas Electronics Corporation, Kawasaki-shi, Kanagawa (JP)

( * ) Notice: Subject to any disclaimer, the term of this patent is extended or adjusted under 35 U.S.C. 154(b) by 877 days.

(21) Appl. No.: 12/000,613

(22) Filed: Dec. 14, 2007

(65) Prior Publication Data

US 2008/0143665 A1 Jun. 19, 2008

(30) Foreign Application Priority Data

Dec. 19, 2006 (JP) ..... 2006-340865

(51) Int. Cl.
*G09G 3/36* (2006.01)

(52) U.S. Cl. ..... 345/96; 345/54; 345/209

(58) Field of Classification Search ..... None
See application file for complete search history.

(56) References Cited

U.S. PATENT DOCUMENTS

| | | | | |
|---|---|---|---|---|
| 6,587,089 | B1 | 7/2003 | Nakajima | |
| 6,707,442 | B2 * | 3/2004 | Watanabe | 345/100 |
| 2002/0041274 | A1 | 4/2002 | Watanabe | |
| 2002/0075212 | A1 * | 6/2002 | Song | 345/87 |
| 2004/0070581 | A1 | 4/2004 | Hiraki et al. | |
| 2004/0108988 | A1 * | 6/2004 | Choi | 345/96 |
| 2004/0222954 | A1 * | 11/2004 | Lueder | 345/87 |
| 2006/0017680 | A1 | 1/2006 | Chen et al. | |
| 2006/0022927 | A1 * | 2/2006 | Woo et al. | 345/89 |

FOREIGN PATENT DOCUMENTS

| | | |
|---|---|---|
| JP | 11-249623 | 9/1999 |
| JP | 11-305735 | 11/1999 |
| JP | 2002-108303 | 4/2002 |

OTHER PUBLICATIONS

Office Action for Application No. 12/010,840 dated Jan. 5, 2011.
Office Action in co-pending U.S. Appl. No. 12/010,840, dated May 27, 2011.

* cited by examiner

*Primary Examiner* — Sumati Lefkowitz
*Assistant Examiner* — Jesus Hernandez
(74) *Attorney, Agent, or Firm* — McGinn Intellectual Property Law Group, PLLC

(57) ABSTRACT

A liquid crystal display apparatus includes a liquid crystal display panel having a data line and a source driver for supplying a data signal to the data line based on a polarity signal. A polarity of the data signal is determined based on the polarity signal. The source driver includes an offset cancel control circuit for generating an offset cancel control signal and an output amplifier used to generate the data signal. The output amplifier is constructed so as to invert a polarity of an offset voltage based on the offset cancel control signal. The offset cancel control signal is generated based on the polarity signal.

9 Claims, 15 Drawing Sheets

DISPLAY APPARATUS, SOURCE DRIVER, AND DISPLAY PANEL DRIVING METHOD

BACKGROUND OF THE INVENTION

1. Field of the Invention

The present invention relates to a liquid crystal display apparatus, a driver for a liquid crystal display panel, and a liquid crystal display panel driving method. More particularly, the present invention relates to a technique for suppressing quality deterioration of a display image which is caused by an offset voltage of an amplifier integrated in a driver of the liquid crystal display panel.

2. Description of the Related Art

One of technologies, which are most widely used to drive a liquid crystal display panel, is an inversion drive method. The inversion drive method is one involving inverting the polarity of a data signal supplied to a data line (signal line) at predetermined spatial cycles and time cycles in order to prevent the so-called burn-in phenomenon. Note that, in this specification, the polarity of a data signal is defined relative to a voltage level (common voltage) of a common electrode of the liquid crystal display panel. When a data signal has a signal level higher than a common voltage VCOM, the polarity of the data signal is defined as a "positive" polarity. In contrast to this, when a data signal has a signal level lower than the common voltage VCOM, the polarity of the data signal is defined as a "negative" polarity. The inversion drive method involves reducing a direct current component of a voltage applied to a liquid crystal capacitor of a pixel to effectively prevent the occurrence of the burn-in phenomenon.

In the inversion drive, various cycles for inverting the polarity of the data signal may be selected. In a dot inversion drive method which is one of the most typical examples of the inversion drive method, data signals whose polarities are opposite to each other are written into adjacent pixels in any one of the vertical direction and the horizontal direction. That is, in the dot inversion drive method, the polarity of the data signal is inverted for each pixel in any one of the vertical direction and the horizontal direction. When a large-size liquid crystal display panel is driven, in many cases, although the polarity of the data signal in the horizontal direction is inverted for each pixel, the polarity of the data signal in the vertical direction is inverted every two pixels. In this specification, the inversion drive method in which a cycle, at which the polarity of the data signal in the vertical direction is inverted, corresponds to $\alpha$-pixel(s) is referred to as an $\alpha$H inversion drive method. For example, the inversion drive method of inverting the polarity of the data signal in the vertical direction for each pixel (as in the dot inversion drive method) is described as a 1H inversion drive method. In addition, the inversion drive method of inverting the polarity of the data signal in the vertical direction every two pixels (as in the dot inversion drive method) is described as a 2H inversion drive method.

The data signal is normally generated as follows. A driver for generating a data signal (which is often called a source driver) includes a grayscale voltage generating circuit, a D/A converter, and an output amplifier, which are integrated therein. The grayscale voltage generating circuit generates a set of grayscale voltages having voltage levels respectively corresponding to grayscale levels which a pixel can express. The D/A converter selects a target grayscale voltage from the set of grayscale voltages based on display data and outputs the selected grayscale voltage to the output amplifier. The display data is data indicating a grayscale level of a pixel to be driven.

The output amplifier outputs, to a data line, a data signal having a voltage level equal to the grayscale voltage supplied from the D/A converter. A differential amplifier in which an output terminal of an output stage thereof is connected with one of two input terminals of an input differential stage thereof, that is, a voltage follower is used as the output amplifier in many cases.

In general, in order to generate the grayscale voltage in the grayscale voltage generating circuit, a resistance ladder and an amplifier (operational amplifier) for supplying a bias voltage to the resistance ladder are used. A set of grayscale voltages are generated by dividing the bias voltage by the resistance ladder. The bias voltage outputted from the amplifier connected with the resistance ladder is determined such that the grayscale voltage becomes a voltage level reflecting a $\gamma$-curve of the liquid crystal display panel. Therefore, the amplifier connected with the resistance ladder is often called a $\gamma$-amplifier. In many cases, a voltage follower is used as the $\gamma$-amplifier.

A problem regarding the driver of the liquid crystal display panel is that the amplifier integrated therein has an offset voltage and thus a voltage actually outputted from the amplifier may be different from a target value. For example, when the output amplifier has the offset voltage, the voltage level of the data signal is deviated from the target value, so a voltage written into the pixel is deviated from the target value. This causes an actual grayscale level of the pixel to be different from a target grayscale level to deteriorate the quality of an image. In particular, when the offset voltage varies for each amplifier, an offset problem is serious. This is because a variation in offset voltage is recognized by the human eye as longitudinal streak-like unevenness extending in a data line direction. Similarly, when the $\gamma$-amplifier has the offset voltage, the actual grayscale level of the pixel is deviated from the target grayscale level to deteriorate the quality of the image.

An effective method of avoiding the problem of the offset voltage of the amplifier is that the polarity of the off set voltage is inverted at appropriate cycles. Note that, in this specification, the polarity of the offset voltage means a magnitude relationship between a voltage desired to be outputted from the amplifier (hereinafter, referred to as "target voltage") and a voltage actually outputted from the amplifier (hereinafter, referred to as "actual voltage") and thus is different in concept from the polarity of the data signal. When the polarity of the offset voltage is inverted at appropriate cycles, it is possible to prevent the influence of the offset voltage from being sensed by the visual sense of human. Hereinafter, when the actual voltage is higher than the target voltage, the polarity of the offset voltage may be referred to as the "positive polarity". In addition, when the actual voltage is lower than the target voltage, the polarity of the offset voltage may be referred to as the "negative polarity".

As compared with a reduction in offset voltage, it is technically easy to invert the polarity of the offset voltage. This is a more practical approach. The offset voltage of the amplifier is caused mainly by a variation between threshold voltages of a pair of MOS transistors included in the input differential stage and a variation between threshold voltages of a pair of MOS transistors included in an active load (for example, a current mirror circuit) connected with the input differential stage. Therefore, for example, when a connection relationship between the input terminal of the amplifier and the pair of MOS transistors included in the input differential stage and a connection relationship between the pair of MOS transistors included in the active load are changed, the polarity of the offset voltage can be inverted while the offset voltage is maintained at the same amplitude.

To be more specific, a technique for alternately using a pair of MOS transistors of an offset input differential stage at a cycle corresponding to four frame periods to invert the polarity of the offset voltage, thereby avoiding the problem of the offset voltage is disclosed in JP 11-305735 A (see, for example, paragraph [0125]).

A technique for inverting the polarity of the offset voltage every predetermined number of lines during a predetermined number of frame periods, thereby avoiding the problem of the offset voltage is disclosed in JP 2002-108303 A. JP 2002-108303 A discloses, for example, that, when a frame period includes eight lines, the polarity of the offset voltage is inverted every seven horizontal lines to cancel the offset voltage at a cycle corresponding to 14 frame periods.

In order to further improve the image quality, as disclosed in JP 11-249623 A, it is suitable to invert the polarity of the offset voltage every predetermined number of horizontal lines during each frame period. JP 11-249623 A discloses a technique for inverting the polarity of the offset voltage every n-horizontal lines during each frame period and every n-frame periods, thereby avoiding the problem of the offset voltage. JP 11-249623 A further discloses a source driver for generating control signals (A and B) for controlling the polarity of the offset voltage of an output amplifier based on an output timing control clock (CL1) for outputting display data stored in a data latch circuit to the signal line of the liquid crystal display panel and a frame period recognition signal (FLMN) for recognizing each frame period, thereby inverting the polarity of the offset voltage every two horizontal lines during each frame period and every two frame periods (see, for example, paragraphs [0017] and [0055] and FIG. 24). The output timing control clock (CL1) and the frame period recognition signal (FLMN) are used to generate the control signals (A and B), so a spatial cycle at which the polarity of the offset voltage is inverted is fixed to the two horizontal lines in the circuit disclosed in JP 11-249623 A.

The technique for inverting the polarity of the offset voltage every predetermined number of lines as disclosed in JP 11-249623 A is certainly effective for the improvement of image quality. The inventor(s) of the present invention found that the conventional source driver disclosed in JP 11-249623 A has a problem in that, when the spatial cycle at which the polarity of the data signal is inverted is made variable, the image quality for each usable spatial cycle cannot be satisfactorily maintained. For example, there is the case where a user desires a source driver adapted to both the 1H inversion drive method and the 2H inversion drive method. According to the conventional source driver, an image cannot be displayed with satisfactory quality for both the 1H inversion drive method and the 2H inversion drive method. This is because the cycle at which the polarity of the offset voltage is inverted is fixed in the conventional source driver. In the case of the 1H inversion drive method (such as the dot inversion drive method), it is suitable to fixedly invert the polarity of the offset voltage every two lines as in the conventional source driver. However, in the case of the 2H inversion drive method, such fixed inversion is not suitable.

For example, as shown in FIG. 1, assume that a data signal is generated by an output amplifier which has two states, that is, a state "A" in which the polarity of the offset voltage is "positive" and a state "B" in which the polarity of the offset voltage is "negative" and can generate any of data signals whose polarities are positive and negative. Note that, in an actual case, when the output amplifier can have two states, a state in which the polarity of the offset voltage is "positive" is unknown.

The output amplifier can generate one of four types of data signals as described below.

Type 1: both of polarity of data signal and polarity of offset voltage are positive (upward direction arrow in state "A")

Type 2: polarity of data signal is negative and polarity of offset voltage is positive (downward direction arrow in state "A")

Type 3: polarity of data signal is positive and polarity of offset voltage is negative (upward direction arrow in state "B")

Type 4: both of polarity of data signal and polarity of offset voltage are negative (downward direction arrow in state "B")

In FIG. 1, a common voltage VCOM indicates a voltage level of a common electrode of the liquid crystal display panel. According to the studies made by the inventor(s) of the present invention, in order to improve the quality of an image, it is suitable to supply the four types of data signals to pixels of the liquid crystal display panel in a spatially uniform manner.

Because the spatial cycle at which the polarity of the offset voltage is inverted is fixed to the two horizontal lines, the source driver described in JP 11-249623 is suitable for the 1H inversion drive method but not for the 2H inversion drive method. FIGS. 2A and 2B show types of data signals supplied to respective pixels during each frame period in the case where the source driver described in JP 11-249623 performs the 1H inversion drive method (dot inversion drive method) and in the case where the source driver performs the 2H inversion drive method. In FIGS. 2A and 2B, symbols "↑A", "↓A", "↑B", and "↓B" have the following meanings.

"↑A": pixel to which data signal whose polarity is positive is supplied from output amplifier having state "A" (that is, pixel to which data signal of "type 1" is supplied)

"↓A": pixel to which data signal whose polarity is negative is supplied from output amplifier having state "A" (that is, pixel to which data signal of "type 2" is supplied)

"↑B": pixel to which data signal whose polarity is positive is supplied from output amplifier having state "B" (that is, pixel to which data signal of "type 1" is supplied)

"↓B": pixel to which data signal whose polarity is negative is supplied from output amplifier having state "B" (that is, pixel to which data signal of "type 2" is supplied)

Note that, according to the operation shown in FIGS. 2A and 2B, the state of the output amplifier is switched every two lines and two frame periods.

As shown in FIG. 2A, when the 1H inversion drive method is performed, the four types of data signals appear in a pixel column. For example, during a first frame period, the types of data signals supplied to respective pixels located in the leftmost column are "↑A", "↓A", "↑B", and "↓B" in sequence. However, as shown in FIG. 2B, when the 2H inversion driye method is performed, only two types of data signals appear in a pixel column. For example, during the first frame period, the types of data signals supplied to the respective pixels located in the leftmost column are "↑A", "↑A", "↓B", and "↓B" in sequence, so pixels in which the types of the data signals are "↓A" and "↑B" do not appear. Therefore, when the 2H inversion drive method is performed, the four types of data signals are not supplied in a spatially uniform manner. Thus, the 2H inversion drive method causes quality deterioration.

As described above, the conventional source driver in which the spatial cycle at which the polarity of the offset voltage is inverted is fixed has the problem that, when the spatial cycle at which the polarity of the data signal is inverted is made variable, the image quality for each usable spatial cycle cannot be satisfactorily maintained. It is preferable to solve the problem using a simple circuit.

SUMMARY OF THE INVENTION

In order to solve the above-mentioned problem, the present invention employs the following means. In order to clarify a correspondence relationship between "What is claimed is" and "DETAILED DESCRIPTION OF THE PREFERRED EMBODIMENTS", technical matters for the means are expressed by numbers and symbols which are used in "DETAILED DESCRIPTION OF THE PREFERRED EMBODIMENTS". Note that the numbers and symbols should hot be used to restrictively interpret the technical scope of the present invention as described in "What is claimed is".

A liquid crystal display apparatus according to the present invention includes a liquid crystal display panel (1) having a data line (11) and a source driver (3) for supplying a data signal to the data line (11) based on a polarity signal (POL) A polarity of the data signal is determined based on the polarity signal (POL). The source driver (3) includes an offset cancel control circuit (40) for generating an offset cancel control signal (OCC) and an amplifier (38) (71) used to generate the data signal. The amplifier (38) (71) is constructed so as to invert a polarity of an offset voltage based on the offset cancel control signal (OCC) The offset cancel control circuit (40) generates the offset cancel control signal (OCC) based on the polarity signal (POL).

According to the liquid crystal display apparatus having the above-mentioned structure, the offset cancel control signal (OCC) is generated based on the polarity signal (POL), so a cycle at which the polarity of the offset voltage is inverted can be automatically and optimally controlled corresponding to a cycle at which the polarity of the data signal is inverted. Therefore, according to the structure of the liquid crystal display apparatus, a spatial cycle at which the polarity of the offset voltage is inverted can be automatically controlled corresponding to a spatial cycle at which the polarity of the data signal is inverted, to satisfactorily maintain the quality of a display image.

According to the present invention, the spatial cycle at which the polarity of the offset voltage is inverted can be automatically controlled corresponding to the spatial cycle at which the polarity of the data signal is inverted, to satisfactorily maintain the quality of the display image.

DETAILED DESCRIPTION OF THE PREFERRED EMBODIMENTS

Hereinafter, embodiments of the present invention will be described with reference to the attached drawings. Note that, in the attached drawings, the same constituent components are expressed by the same symbols. In addition, if necessary, the same plurality of constituent components may be distinguished from each other by subscripts attached to the symbols.

First Embodiment

Figure 3:
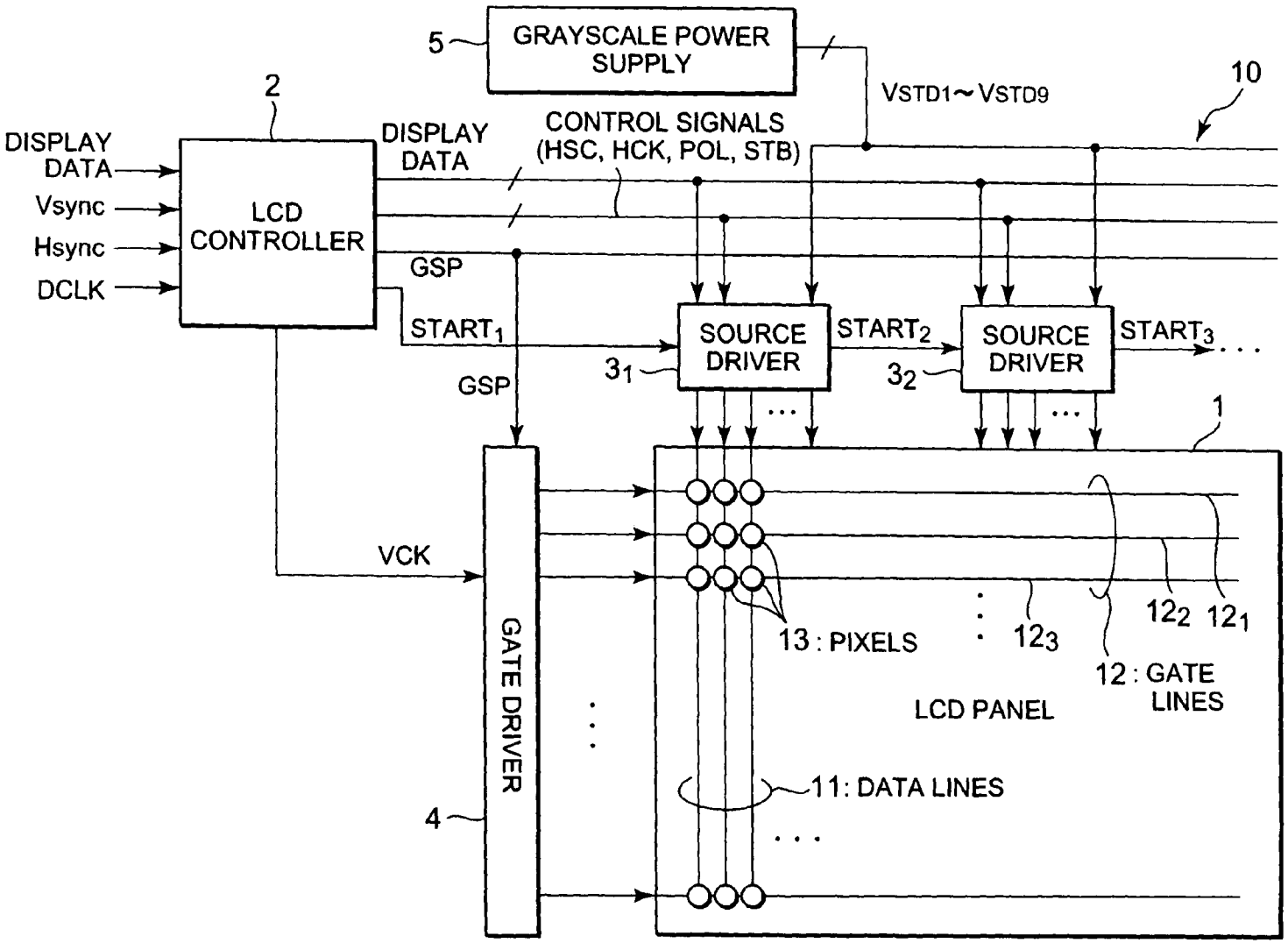
FIG. 3 is a block diagram showing a structure of a liquid crystal display apparatus according to a first embodiment of the present invention.

FIG. 3 is a block diagram showing a structure of a liquid crystal display apparatus 10 according to a first embodiment of the present invention. The liquid crystal display apparatus 10 includes an LCD panel 1, an LCD controller 2, source drivers 3, a gate driver 4, and a grayscale power supply 5.

The LCD panel 1 includes data lines (signal lines) 11 extending in the vertical direction, gate lines (scanning lines) 12 extending in the horizontal direction, and pixels 13 provided at intersections therebetween. Hereinafter, the pixels 13 of a row which are connected with the same one of the gate lines 12 may be referred to as a line. The pixels 13 of a row which are connected with a gate line 12*i* may be referred to as the pixels 13 of an i-th line.

The LCD controller 2 controls the source drivers 3 and the gate driver 4 to display a target image on the LCD panel 1. To be specific, the LCD controller 2 transfers display data received from an outside to the source drivers 3 and supplies various control signals to the source drivers 3 and the gate driver 4. The operation of the LCD controller 2 is controlled based on various control signals (for example, horizontal synchronization signal Hsync, vertical synchronization signal Vsync, and dot clock signal DCLK,).

Control signals supplied from the LCD controller 2 to each of the source drivers 3 include the horizontal synchronization signal HSC, a horizontal clock HCK, a polarity signal POL, and a strobe signal (latch signal) STB. A start pulse signal $START_1$ is supplied from the LCD controller 2 to a source driver $\mathbf{3}_1$. The technical meaning of the control signals will be given in detail together with the description of the source drivers 3.

On the other hand, control signals supplied to the gate driver 4 include a vertical clock VCK and a gate start pulse signal GSP. The gate start pulse signal GSP serves as a trigger for causing the gate driver 4 to start the scanning of the gate lines 12. When the gate start pulse signal GSP is activated, the gate driver 4 activates the gate lines 12 in order from one of the gate lines 12 which is close to the source drivers 3. A timing at which the gate start pulse signal GSP is activated is synchronized with the vertical synchronization signal Vsync supplied to the LCD controller 2. After the lapse of a predetermined time from the activation of the vertical synchronization signal Vsync, the gate start pulse signal GSP is activated.

The source drivers 3 supply data signals to the respective data lines 11 of the LCD panel 1. The data signals have voltage levels corresponding to grayscale levels of the pixels 13. When the data signals are supplied to the pixels 13, pixel voltages corresponding to target grayscale levels are written into the pixels 13.

The gate driver 4 scans the gate lines 12 of the LCD panel 1. That is, the gate lines 12 are successively activated. The data signals generated by the source drivers 3 are supplied to the pixels 13 connected with the activated one of the gate lines 12.

The grayscale power supply 5 supplies grayscale power supply voltages VSTD1 to VSTD9 to the respective source drivers 3. As described later, the grayscale power supply voltages VSTD1 to VSTD9 are used to generate a set of grayscale voltages respectively corresponding to l e grayscale levels which each of the pixels 13 can express in the respective source drivers 3.

Figure 4:
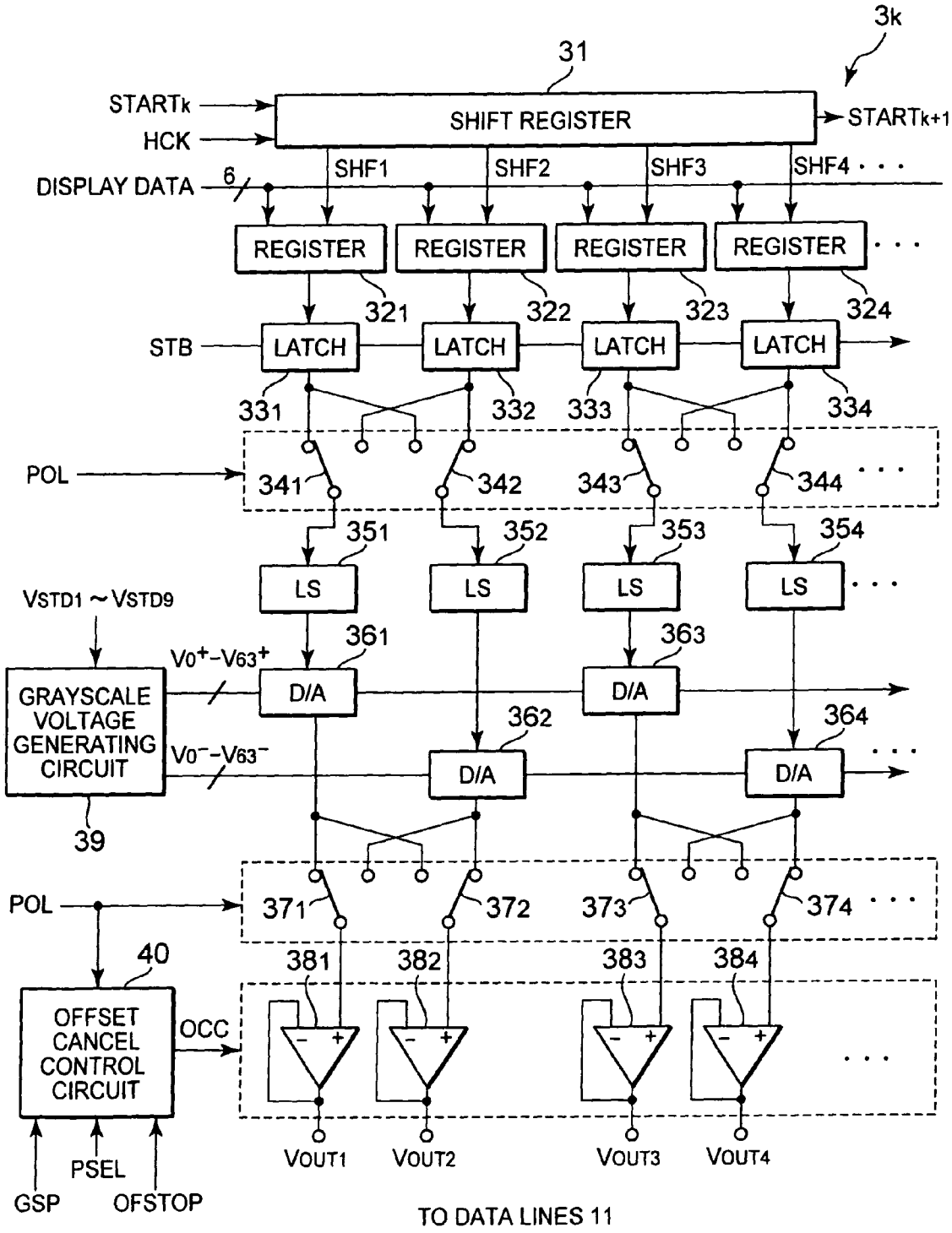
FIG. 4 is a block diagram showing a structure of a source driver according to the first embodiment of the present invention.

FIG. 4 is a block diagram showing a structure of each of the source drivers 3. The source driver 3 includes a shift register 31, registers $\mathbf{32}_1$ to $\mathbf{32}_n$, latch circuits $\mathbf{33}_1$ to $\mathbf{33}_n$, cross switches $\mathbf{34}_1$ to $\mathbf{34}_n$, level shifters $\mathbf{35}_1$ to $\mathbf{35}_n$, D/A converters $\mathbf{36}_1$ to $\mathbf{36}_n$, cross switches $\mathbf{37}_1$ to $\mathbf{37}_n$, output amplifiers $\mathbf{38}_1$ to $\mathbf{38}_n$, a grayscale voltage generating circuit 39, an offset cancel control circuit 40, and output terminals VOUT1 to VOUTn connected with the data lines 11. To simplify the drawing, the four registers 32, the four latch circuits 33, the four cross switches 34, the four level shifters 35, the four D/A converters 36, the four cross switches 37, and the four output terminals VOUT are shown therein.

The shift register 31 generates, in response to a start pulse signal $START_k$, shift signals SHF1 to SHFn for enabling the shift resistors 32 to latch display data. The start pulse signal $START_k$ is a signal for enabling a source driver $\mathbf{3}_k$ to start the capture of display data. As shown in FIG. 3, a start pulse signal $START_1$ is supplied from the LCD controller 2 to the source driver $\mathbf{3}_1$. The start pulse signal $START_k$ is supplied to the other source driver $\mathbf{3}_k$ from a source driver $\mathbf{3}_{k-1}$ adjacent thereto. When the start pulse signal $START_k$ is activated, the shift register 31 performs a shift operation to successively activate the shift signals SHF1 to SHFn. When the shift signal SHFn is finally activated, the shift register 31 of the source driver $\mathbf{3}_k$ activates a start pulse signal $START_{k+1}$ supplied to an adjacent source driver $\mathbf{3}_{k+1}$.

The registers $\mathbf{32}_1$ to $\mathbf{32}_n$ latch the display data in response to the activated shift signals SHF1 to SHFn.

When the strobe signal STB is activated, the latch circuits $\mathbf{33}_1$ to $\mathbf{33}_n$ latch the display data stored in the registers $\mathbf{32}_1$ to $\mathbf{32}_n$ and output the latched display data to the cross switches $\mathbf{34}_1$ to $\mathbf{34}_n$.

The cross switches $\mathbf{34}_1$ to $\mathbf{34}_2$ switch connection relationships between the latch circuits $\mathbf{33}_1$ to $\mathbf{33}_n$ and the level shifters $\mathbf{35}_1$ to $\mathbf{35}_n$ in response to the polarity signal POL. The polarity signal POL is a signal for specifying the polarities of the data signals supplied to the respective data lines 11. In this embodiment, when the polarity signal POL is in a "High" level, the odd-numbered cross switch $\mathbf{34}_{2i-1}$ connects the odd-numbered latch circuit $\mathbf{33}_{2i-1}$ with the odd-numbered level shifter $\mathbf{35}_{2i-1}$ and the even-numbered cross switch $\mathbf{34}_{2i}$ connects the even-numbered latch circuit $\mathbf{33}_{2i}$ with the even-numbered level shifter $\mathbf{35}_{2i}$. On the other hand, when the polarity signal POL is in a "Low" level, the odd-numbered cross switch $\mathbf{34}_{2i-1}$ connects the even-numbered latch circuit $\mathbf{33}_{2i}$ with the odd-numbered level shifter $\mathbf{35}_{2i-1}$ and the even-numbered cross switch $\mathbf{34}_{2i}$ connects the odd-numbered latch circuit $\mathbf{33}_{2i-1}$ with the even-numbered level shifter $\mathbf{35}_{2i}$.

The level shifters $\mathbf{35}_1$ to $\mathbf{35}_n$ are provided for matching output signal levels of the latch circuits $\mathbf{33}_1$ to $\mathbf{33}_n$ and input signal levels of the D/A converters $\mathbf{36}_1$ to $\mathbf{36}_n$. The level shifters $\mathbf{35}_1$ to $\mathbf{35}_n$ transfer the display data received from the latch circuits $\mathbf{33}_1$ to $\mathbf{33}_n$ to the D/A converters $\mathbf{36}_1$ to $\mathbf{36}_n$ while signal levels thereof are changed.

The D/A converters $\mathbf{36}_1$ to $\mathbf{36}_n$ perform the D/A conversion on the display data sent from the latch circuits $\mathbf{33}_1$ to $\mathbf{33}_n$ to output grayscale voltages having voltage levels corresponding to the display data. Note that the latch circuits 33 from which the respective D/A converters 36 receive the display data are switched by the cross switches 34.

The odd-numbered D/A converter $\mathbf{36}_{2i-1}$ outputs a grayscale voltage whose polarity is positive. The even-numbered D/A converter $\mathbf{36}_{2i}$ outputs a grayscale voltage whose polarity is negative. To be more specific, a set of grayscale voltages V0+ to V63+ whose polarities are positive (relative to common voltage VCOM) are supplied from the grayscale voltage generating circuit 39 to the odd-numbered D/A converter $\mathbf{36}_{2i-1}$. The odd-numbered D/A converter $\mathbf{36}_{2i-1}$ selects a voltage corresponding to the received display data from the grayscale voltages V0+ to V63+ to output the selected grayscale voltage to the cross switch $\mathbf{37}_{2i-1}$. On the other hand, a set of grayscale voltages V0− to V63− whose polarities are negative are supplied from the grayscale voltage generating circuit 39 to the even-numbered D/A converter $\mathbf{36}_{2i}$. The even-numbered D/A converter $\mathbf{36}_{2i}$ selects a grayscale voltage corresponding to the received display data from the grayscale voltages V0− to V63− to output the selected grayscale voltage to the cross switch $\mathbf{37}_{2i}$.

The cross switches $\mathbf{37}_1$ to $\mathbf{37}_n$ switch connection relationships between the D/A converters $\mathbf{36}_1$ to $\mathbf{36}_n$ and the output amplifiers $\mathbf{38}_1$ to $\mathbf{38}_n$ in response to the polarity signal POL. In this embodiment, when the polarity signal POL is in the "High" level, the odd-numbered cross switch $\mathbf{37}_{2i-1}$ connects the odd-numbered D/A converter $\mathbf{36}_{2i-1}$ with the odd-numbered output amplifier $\mathbf{38}_{2i-1}$ and the even-numbered cross switch $\mathbf{37}_{2i}$ connects the even-numbered D/A converter $\mathbf{36}_{2i}$ with the even-numbered output amplifier $\mathbf{38}_{2i}$. On the other hand, when the polarity signal POL is in the "Low" level, the odd-numbered cross switch $\mathbf{37}_{2i-1}$ connects the even-numbered D/A converter $\mathbf{36}_{2i}$ with the odd-numbered output amplifier $\mathbf{38}_{2i-1}$ and the even-numbered cross switch $\mathbf{37}_{2i}$ connects the odd-numbered D/A converter $\mathbf{36}_{2i-1}$ with the even-numbered output amplifier $\mathbf{38}_{2i}$.

The output amplifiers $38_1$ to $38_n$ receive the grayscale voltages from the D/A converters $36_1$ to $36_n$ and output data signals having voltage levels equal to the received grayscale voltages to the data lines through the output terminals VOUT1 to VOUTn. In this embodiment, a voltage follower having a rail-to-rail structure is used as each of the output amplifiers $38_1$ to $38_n$. Each of the output amplifiers $38_1$ to $38_n$ can output both a data signal whose polarity is positive and a data signal whose polarity is negative. The adjacent output amplifiers $38_{2i-1}$ and $38_{2i}$ output data signals whose polarities are different from each other. For details, when the data signal whose polarity is positive is to be outputted from the odd-numbered output amplifier $38_{2i-1}$ and the data signal whose polarity is negative is to be outputted from the even-numbered output amplifier $38_{2i}$, the polarity signal POL is pulled up to the "High" level. Therefore, the odd-numbered D/A converter $36_{2i-1}$ (to which the grayscale voltage whose polarity is positive is supplied) is connected with the odd-numbered output amplifier $38_{2i-1}$ and the even-numbered D/A converter $36_{2i}$ (to which the grayscale voltage whose polarity is negative is supplied) is connected with the even-numbered output amplifier $38_{2i}$. On the other hand, when the data signal whose polarity is negative is to be outputted from the odd-numbered output amplifier $38_{2i-1}$ and the data signal whose polarity is negative is to be outputted from the even-numbered output amplifier $38_{2i}$, the polarity signal POL is pulled down to the "Low" level. Therefore, an output terminal of the odd-numbered D/A converter $36_{2i-1}$ is connected with the even-numbered output amplifier $38_{2i}$ and an output terminal of the even-numbered D/A converter $36_{2i}$ (to which the grayscale voltage whose polarity is negative is supplied) is connected with the odd-numbered output amplifier $38_{2i-1}$.

The output amplifiers $38_1$ to $38_n$ are constructed such that an offset polarity can be inverted based on an offset cancel control signal OCC supplied from the offset cancel control circuit 40. That is, each of the output amplifiers $38_1$ to $38_n$ may have two states whose offset polarities are opposite to each other. The offset polarity is determined based on the offset cancel control signal OCC. Hereinafter, one of the states is defined as a "state A" and the other thereof is defined as a "state-B". The description will be made in each of the case where the output amplifiers $38_1$ to $38_n$ are set to the "state A" when the offset cancel control signal OCC is in the "High" level and the case where the output amplifiers $38_1$ to $38_n$ are set to the "state B" when the offset cancel control signal OCC is in the "Low" level.

Figure 5A:
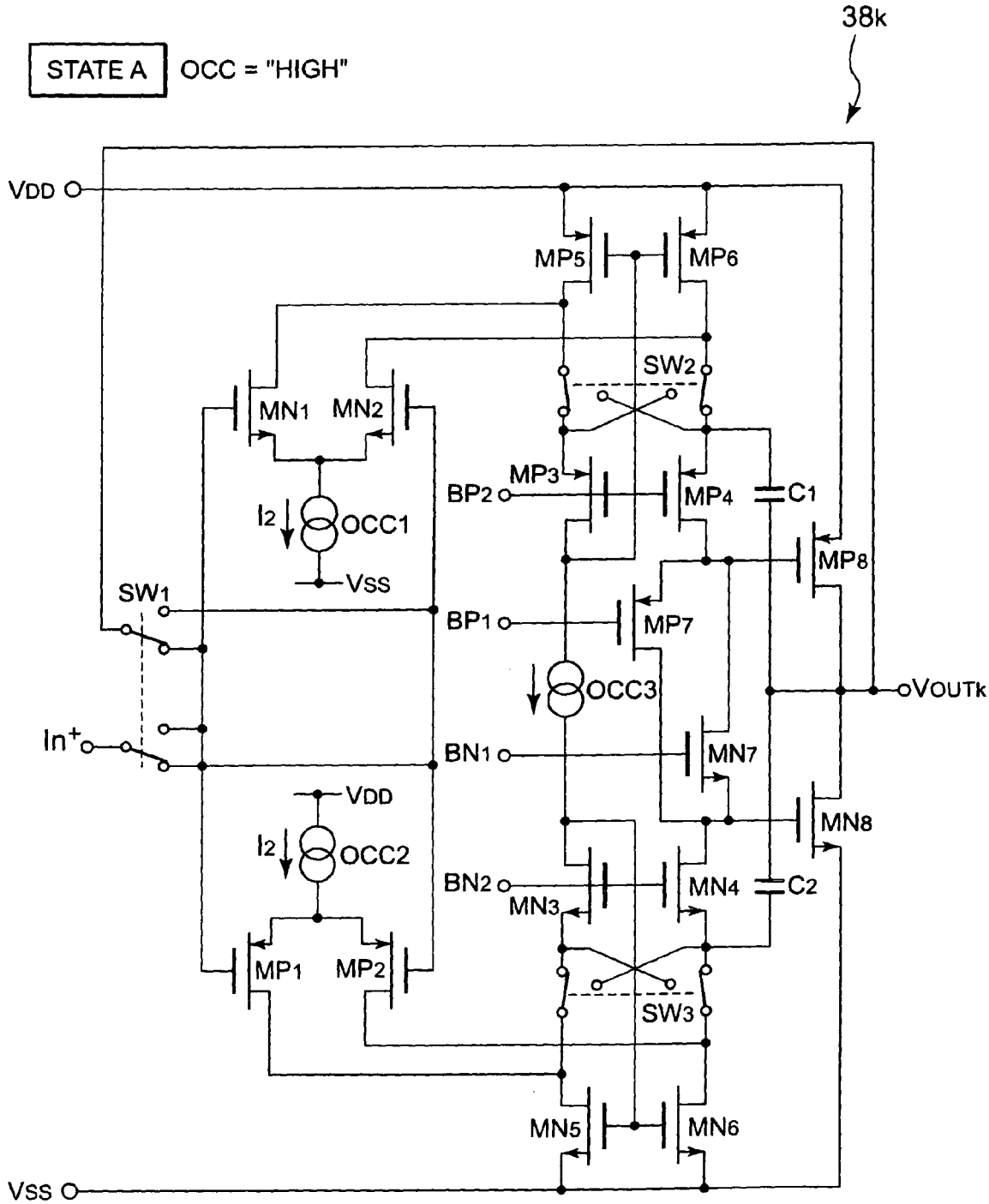
FIG. 5A is a circuit diagram showing a structural example of an output amplifier in the first embodiment of the present invention, which shows a connection relationship among circuit elements in the case where a "state A" is set for the output amplifier.
Figure 5B:
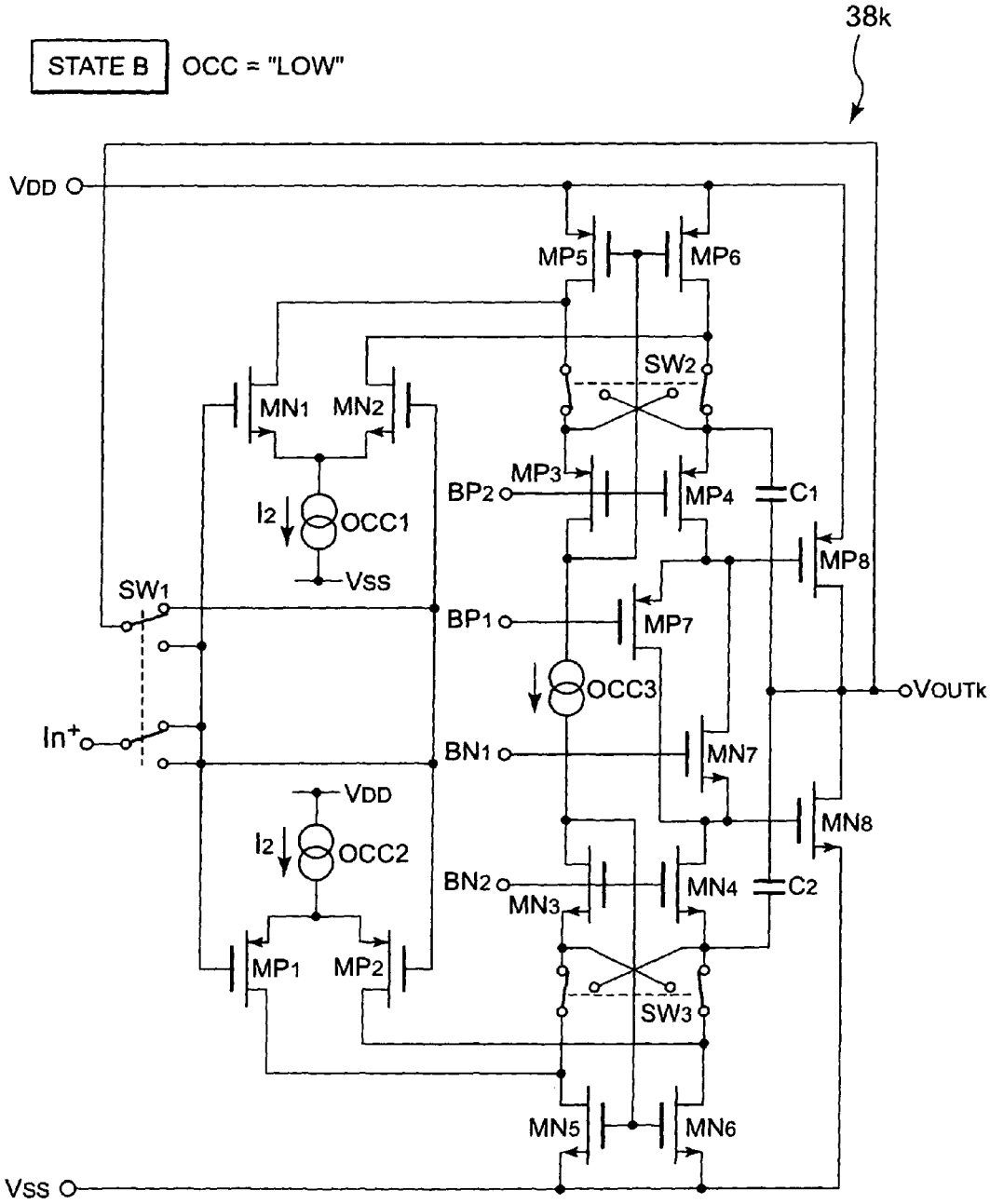
FIG. 5B is a circuit diagram showing a structural example of the output amplifier in the first embodiment of the present invention, which shows a connection relationship among the circuit elements in the case where a "state B" is set for the output amplifier.

FIGS. 5A and 5B are circuit diagrams showing a structural example of each of the output amplifiers $38_1$ to $38_n$. Each of the output amplifiers 38 includes PMOS transistors MP1 to MP8, NMOS transistors MN1 to MN8, switches SW1 to SW3, capacitors C1 and C2, and constant current sources CCS1 to CCS3. The PMOS transistors MP1 and MP2 are constructed as a PMOS transistor pair included in an input differential stage. The NMOS transistors MN1 and MN2 are constructed as an NMOS transistor pair included in the input differential stage. The PMOS transistors MP5 and MP6 are constructed as a PMOS transistor pair included in an active load. The NMOS transistors MN5 and MN6 are constructed as an NMOS transistor pair included in the active load. A bias voltage BP2 is supplied to the gates of the PMOS transistors MP3 and MP4. A bias voltage BP1 is supplied to the gate of the PMOS transistors MP7. A bias voltage BNP2 is supplied to the gates of the NMOS transistors MN3 and MN4. A bias voltage BN1 is supplied to the gate of the NMOS transistors MN7.

In the output amplifier 38 having the above-mentioned structure, the generation of an offset voltage is caused mainly by (1) a variation in threshold voltages of the transistor pairs (PMOS transistors MP1 and MP2 and NMOS transistors MN1 and MN2) included in the input differential stage and (2) a variation in threshold voltages of the transistor pairs (PMOS transistors MP5 and MP6 and NMOS transistors MN5 and MN6) included in the active load.

According to the output amplifier 38 which may have the states shown in FIGS. 5A and 5B, when a connection relationship of the transistor pair included in the input differential stage and a connection relationship of the transistor pair included in the active load are switched by the switches SW1 to SW3, the polarity of the offset voltage can be inverted. The inversion of the polarity of the offset voltage is performed by operating the switches SW1 to SW3 in response to the offset cancel control signal OCC. Note that all the switches SW1 to SW3 are operated in conjunction with one another. FIG. 5A shows a connection state of the switches SW1 to SW3 in the case where the offset cancel control signal OCC is in the "High" level. FIG. 5B shows a connection state of the switches SW1 to SW3 in the case where the offset cancel control signal OCC is in the "Low" level.

Referring to FIG. 5A, when the offset cancel control signal OCC is in the "High" level, the switches SW1 to SW3 operate as follows. The switch SW1 connects an input terminal IN+ with the gate of the PMOS transistor MP2 and the gate of the NMOS transistor MN2 and connects an output terminal VOUTk with the gate of the PMOS transistor MP1 and the gate of the NMOS transistor MN1. The switch SW2 connects the drain of the PMOS transistor MP5 with the source of the PMOS transistor MP3 and connects the drain of the PMOS transistor MP6 with the source of the PMOS transistor MP4. The switch SW3 connects the drain of the NMOS transistor MN5 with the source of the NMOS transistor MN3 and connects the drain of the NMOS transistor MN6 with the source of the NMOS transistor MN4.

On the other hand, referring to FIG. 5B, when the offset cancel control signal OCC is in the "Low" level, the switches SW1 to SW3 operate as follows. The switch SW1 connects the input terminal IN+ with the gate of the PMOS transistor MP1 and the gate of the NMOS transistor MN1 and connects the output terminal VOUTk with the gate of the PMOS transistor MP2 and the gate of the NMOS transistor MN2. The switch SW2 connects the drain of the PMOS transistor MP5 with the source of the PMOS transistor MP4 and connects the drain of the PMOS transistor MP6 with the source of the PMOS transistor MP3. The switch SW3 connects the drain of the NMOS transistor MN5 with the source of the NMOS transistor MN4 and connects the drain of the NMOS transistor MN6 with the source of the NMOS transistor MN3.

Figure 1:
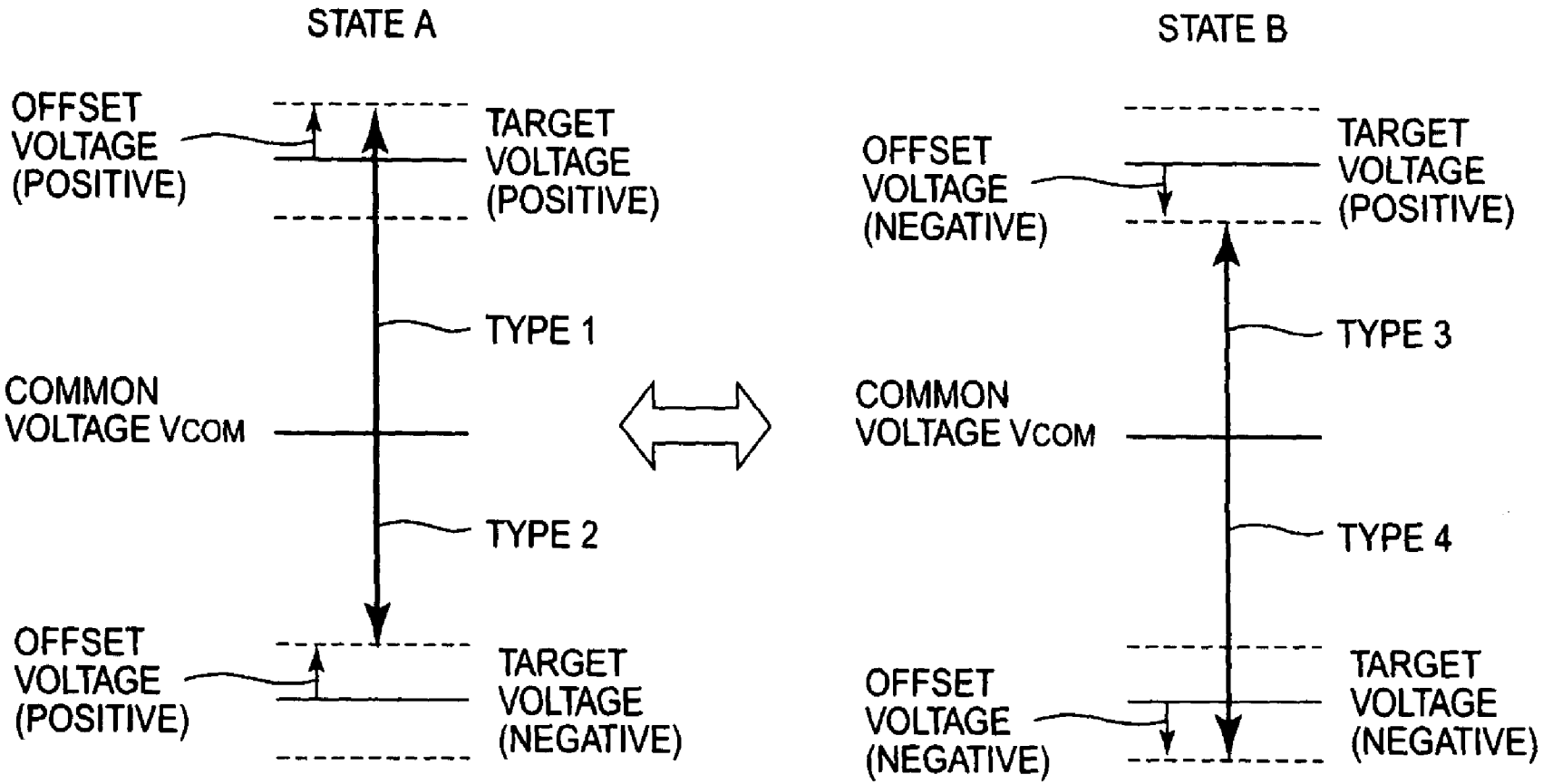
FIG. 1 is an explanatory diagram showing four states of an amplifier.

When the above-mentioned operation is performed, the output amplifier 38 outputs as output voltage VO as described below based on the offset cancel control signal OCC.

$$VO = VIN \pm VOS$$

where VIN indicates the grayscale voltage inputted to the output amplifier 38 and VOS indicates the offset voltage. A double sign "±" indicates that the polarity of the offset voltage is switched depending on whether the offset cancel control signal OCC is in the "High" level or the "Low" level. There are the case where the grayscale voltage VIN supplied to an input terminal of the output amplifier 38 has a positive polarity and the case where the grayscale voltage VIN supplied thereto has a negative polarity, with the result that the respective output amplifiers 38 output the four types of data signals as shown in FIG. 1.

Returning to FIG. 4, the grayscale voltage generating circuit 39 generates the grayscale voltages V0+ to V63+ whose polarities are positive and the grayscale voltages V0− to V63− whose polarities are negative based on the grayscale power supply voltages VSTD1 to VSTD9 received from the grayscale power supply 5. As described above, the grayscale voltages V0+ to V63+ whose polarities are positive are supplied to the odd-numbered D/A converter $\mathbf{36}_{2i-1}$ and the grayscale voltages V0− to V63− whose polarities are negative are supplied to the even-numbered D/A converter $\mathbf{36}_{2i}$.

The offset cancel control circuit 40 generates the offset cancel control signal OCC to be supplied to each of the output amplifiers 38. An offset enable signal OFSTOP, a pattern selection signal PSEL, the gate start pulse signal GSP, and the polarity signal POL are supplied to the offset cancel control circuit 40, so the offset cancel control circuit 40 generates the offset cancel control signal OCC based on the supplied signals.

The offset enable signal OFSTOP is a signal for enabling the inversion control of the polarity of the offset voltage. The inversion control of the polarity of the offset voltage is performed only when the offset enable signal OFSTOP is in the "High" level. When the offset enable signal OFSTOP is in the "Low" level, the offset cancel control signal OCC is held, so the polarity of the offset voltage is not inverted.

The pattern selection signal PSEL is a signal for selecting a pattern for inverting the polarity of the offset voltage. To be specific, when the pattern selection signal PSEL is in the "High" level, the polarity of the offset voltage is inverted every specified number of horizontal lines during each frame period. In addition, the polarity of the offset voltage is inverted every predetermined number of frame periods (every two frame periods in this embodiment). Note that, as described later, the cycle at which the polarity of the offset voltage is inverted during each frame period is determined based on the polarity signal POL. On the other hand, when the pattern selection signal PSEL is in the "Low" level, although the polarity of the offset voltage is inverted every two frame periods, the polarity of offset voltage is held during each frame period.

The gate start pulse signal GSP indicates the start of a frame period, so the gate start pulse signal GSP is used to invert the offset cancel control signal OCC every predetermined number of frame periods, that is, to invert the polarity of the offset voltage. Note that, as described above, the activation of the gate start pulse signal GSP exhibits that each frame period starts. In this embodiment, a signal whose frequency is ¼ of that of the gate start pulse signal GSP is generated and the offset cancel control signal OCC is produced from the ¼-frequency signal. Therefore, the offset cancel control signal OCC is inverted every two frame periods.

The polarity signal POL is used to invert the polarity of the offset voltage during each frame period. The use of the polarity signal POL to produce the offset cancel control signal OCC is one of important technical matters for the liquid crystal display apparatus 10 according to this embodiment. As described above, because the polarity signal POL is the signal for specifying the polarities of the respective data signals, the polarity signal POL is inverted according to the cycle at which the polarity of the data signal is inverted. For example, when the 1H inversion drive method is performed, the polarity signal POL is inverted for each horizontal line. When the 2H inversion drive method is performed, the polarity signal POL is inverted every two horizontal lines. Therefore, when the offset cancel control signal OCC is generated in response to the polarity signal POL, the cycle at which the offset cancel control signal OCC is inverted, that is, the cycle at which the polarity of the offset voltage is inverted can be automatically controlled. This allows that the cycle at which the polarity of the offset voltage is inverted is optimally controlled by a simple circuit. In this embodiment, the offset cancel control signal OCC is inverted during each frame period at a cycle of two times the cycle at which the polarity signal POL is inverted. Thus, the cycle at which the polarity of the offset voltage is inverted is also inverted at the cycle of two times the cycle for inverting the polarity signal POL.

Figure 6A:
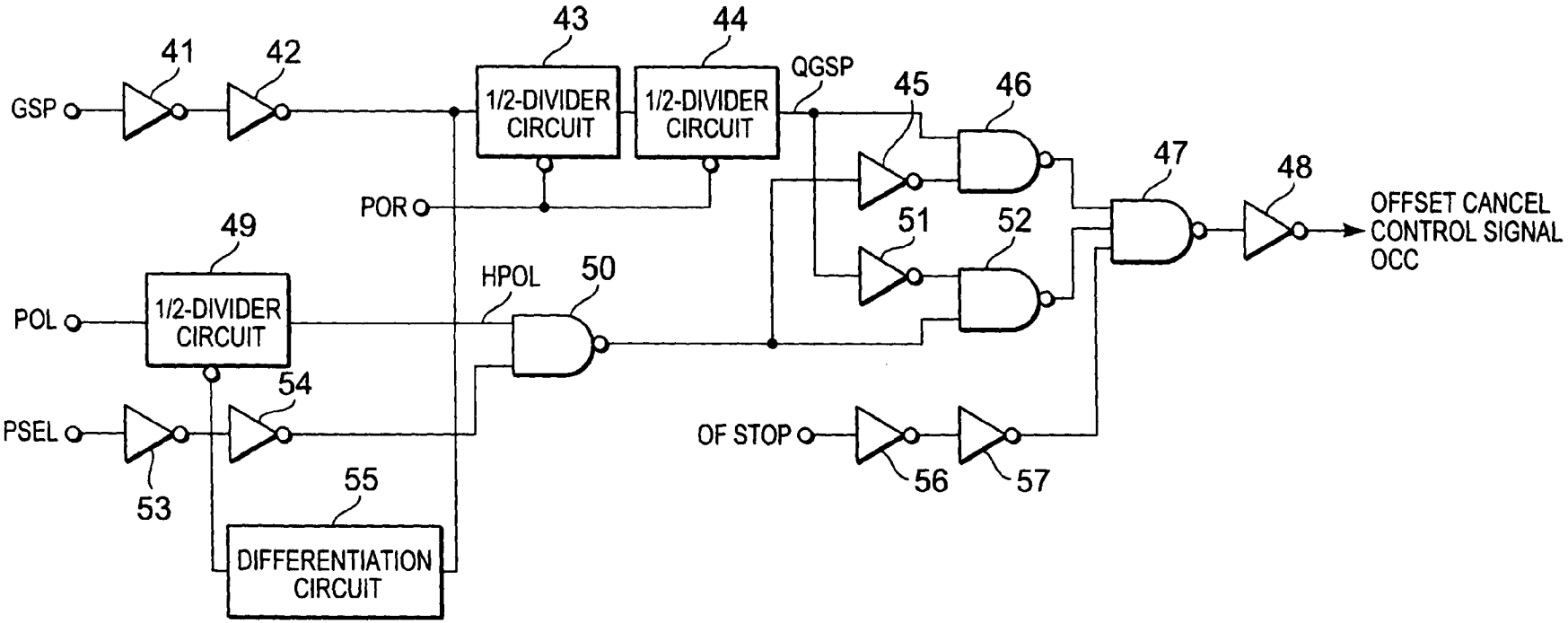
FIG. 6A is a circuit diagram showing a structural example of an offset cancel control circuit in the first embodiment of the present invention and FIG. 6B is a circuit diagram showing a structural example of a differentiation circuit included in the offset cancel control circuit of FIG. 6A.

FIG. 6A is a circuit diagram showing a structural example of the offset cancel control circuit 40. The offset cancel control circuit 40 includes inverters 41, 42, 45, 48, 51, 53, 54, 56, and 57, ½-divider circuits 43, 44, and 49, NAND gates 46, 47, 50, and 52, and a differentiation circuit 55. In the structure shown in FIG. 6A, the ½-divider circuits 43 and 44 are connected in series and thus act as a ¼-divider circuit. The ½-divider circuits 43 and 44 perform ¼-divider on the gate start pulse signal GSP to generate a ¼-divider GSP signal QGSP. The ½-divider circuit 49 performs ½-divider on the polarity signal POL to generate a ½-divided signal HPOL. The offset cancel control signal OCC is produced based on the ¼-divider GSP signal QGSP and the ½-divided signal HPOL.

Figure 6B:
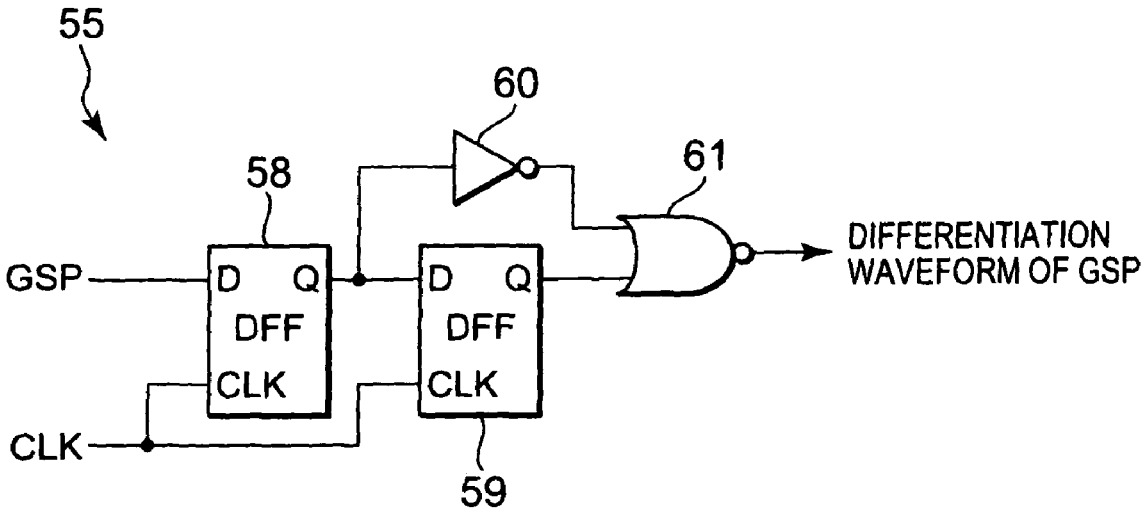

In this embodiment, each of the ½-divider circuits 43, 44, and 49 includes a flip-flop. The flip-flop included in each of the ½-divider circuits 43 and 44 has a reset terminal to which a power-on reset (POR) signal is inputted. When the source driver 3 is power-on reset, the flip-flop included in each of the ½-divider circuits 43 and 44 is reset. The flip-flop included in the ½-divider circuit 49 has a reset terminal connected with an output terminal of the differentiation circuit 55. When the gate start pulse signal GSP is pulled up, an output signal from the differentiation circuit 55 is pulled up to the "High" level for a predetermined period. Therefore, the flip-flop included in the ½-divider circuit 49 is reset when each frame period starts. FIG. 6B shows a structural example of the differentiation circuit 55. In this embodiment, the differentiation circuit 55 includes D flip-flops 58 and 59, an inverter 60, and a NOR gate 61.

Returning to FIG. 6A, the pattern selection signal PSEL is used to switch between enable/disable states of the ½-divided signal HPOL. When the pattern selection signal PSEL is in the "Low" level, an output signal from the NAND gate 50 is held to the "High" level. Therefore, the offset cancel control signal OCC is generated without depending on the polarity signal POL.

The offset enable signal OFSTOP is used to switch between enable/disable states of each of the ¼-divider GSP signal QGSP and the ½-divided signal HPOL. When the pattern selection signal PSEL is in the "Low" level, an output signal from the NAND gate 47 is held to the "High" level. Then, the offset cancel control signal OCC is held to the "Low" level.

Figure 7:
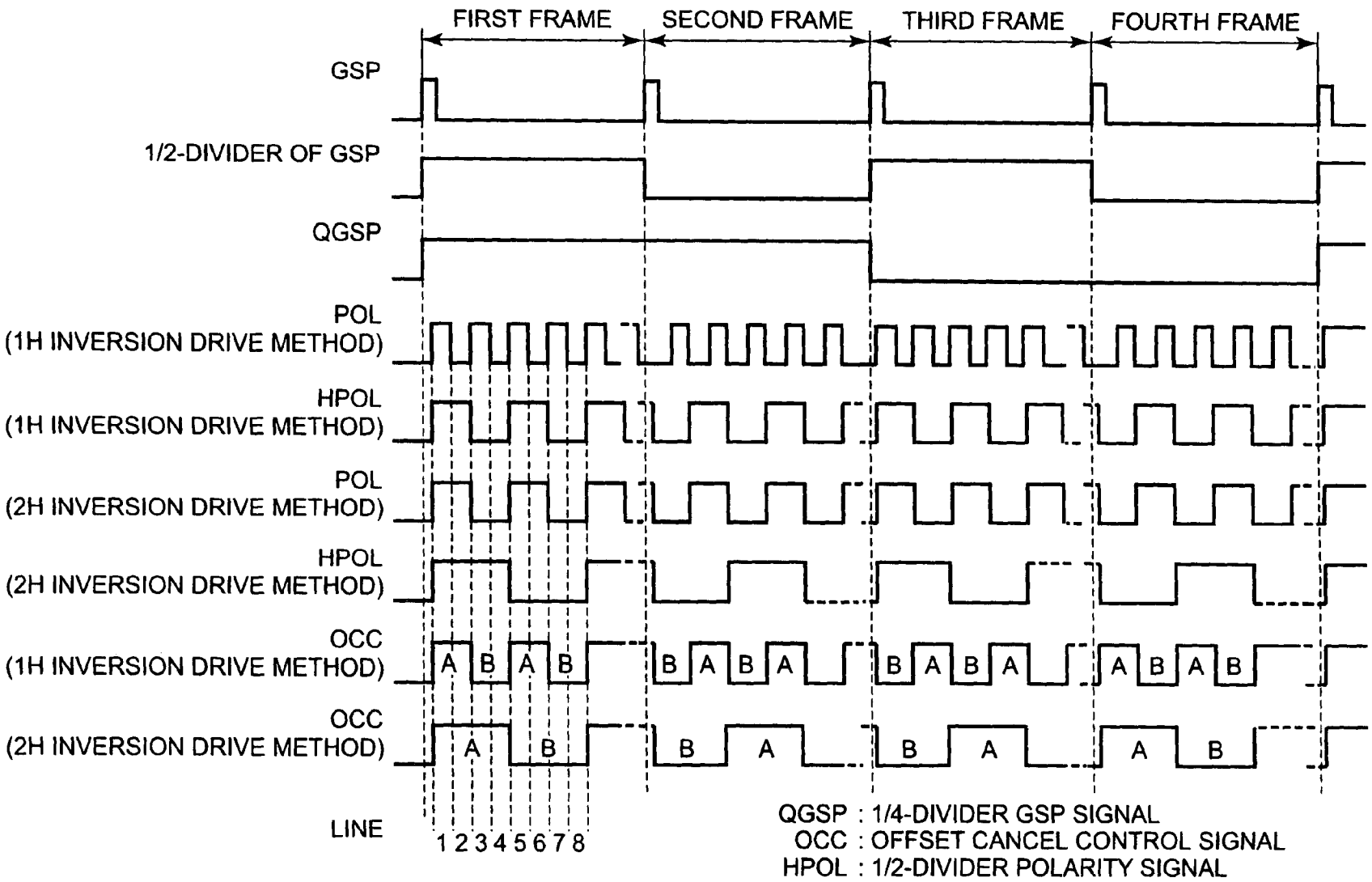
FIG. 7 is a timing chart showing an operation of the offset cancel control circuit in the first embodiment of the present invention.

According to the above-mentioned structure of the source driver 3, the cycle at which the offset cancel control signal OCC is inverted (that is, the cycle at which the polarity of the offset voltage of the output amplifier 38 is inverted) is automatically controlled depending on the cycle at which the polarity of the data signal is inverted (that is, the cycle at which the polarity signal POL is inverted). Therefore, the image quality can be improved. FIG. 7 is a timing chart showing the operation of the offset cancel control circuit 40 in the case where each of the offset enable signal OFSTOP and the pattern selection signal PSEL is set to the "high" level. Note that, each of the offset enable signal OFSTOP and the pattern selection signal PSEL is in the "high" level, so the polarity of the offset voltage is inverted every two horizontal lines during each frame period and inverted every two frame periods.

As shown in FIG. 7, the gate start pulse signal GSP is activated at the beginning of each frame period. Therefore, the gate start pulse signal GSP is inverted every two frame periods (that is, at a cycle of four frame periods).

When the 1H inversion drive method is performed, the polarity signal POL is inverted for each horizontal line (that is, at a cycle of two horizontal lines) during each frame period. When the 2H inversion drive method is performed, the polarity signal POL is inverted every two horizontal lines (that is, at a cycle of four horizontal lines) during each frame period. Note that, in the same horizontal line, the signal level of the polarity signal POL is inverted for each frame period. For example, in a first horizontal line, the signal level of the polarity signal POL is the "high" level during an odd frame period and is the "Low" level during an even frame period.

The offset cancel control signal OCC is inverted during each frame period at the cycle of two times the cycle for inverting the polarity signal POL. In addition, the offset cancel control signal OCC is inverted every two frames in response to the gate start pulse signal GSP. That is, when the 1H inversion drive method is performed, the offset cancel control signal OCC is inverted every two horizontal lines during each frame period. Further, the offset cancel control signal OCC is inverted every two fame periods in response to the gate start pulse signal GSP. On the other hand, when the 2H inversion drive method is performed, the offset cancel control signal OCC is inverted every four horizontal lines during each frame period. Further, the offset cancel control signal OCC is inverted every two fame periods in response to the gate start pulse signal GSP.

As a result, the signal level of the offset cancel control signal OCC is controlled as follows. (i: Natural number) A. In the Case of 1H Inversion Drive Method During a first frame period and a fourth frame period, the offset cancel control signal OCC is in the "High" level for each of (4i−3)-th and (4i−2)-th horizontal lines and is in the "Low" level for each of (4i−1)-th and 4i-th horizontal lines.

In contrast to this, during a second frame period and a third frame period, the offset cancel control signal OCC is in the "Low" level for each of (4i−3)-th and (4i−2)-th horizontal lines and is in the "High" level for each of (4i−1)-th and 4i-th horizontal lines.

B. In the Case of 2H Inversion Drive Method

During the first frame period and the fourth frame period, the offset cancel control signal OCC is in the "High" level for each of (8i−7)-th to (8i−4)-th horizontal lines and is in the "Low" level for each of (4i−3)-th to 8i-th horizontal lines.

In contrast to this, during the second frame period and the third frame period, the offset cancel control signal OCC is in the "Low" level for each of (4i+1)-th and (4i+2)-th horizontal lines and is in the "High" level for each of (4i+1)-th and (4i+2)-th horizontal lines.

Figure 2A:
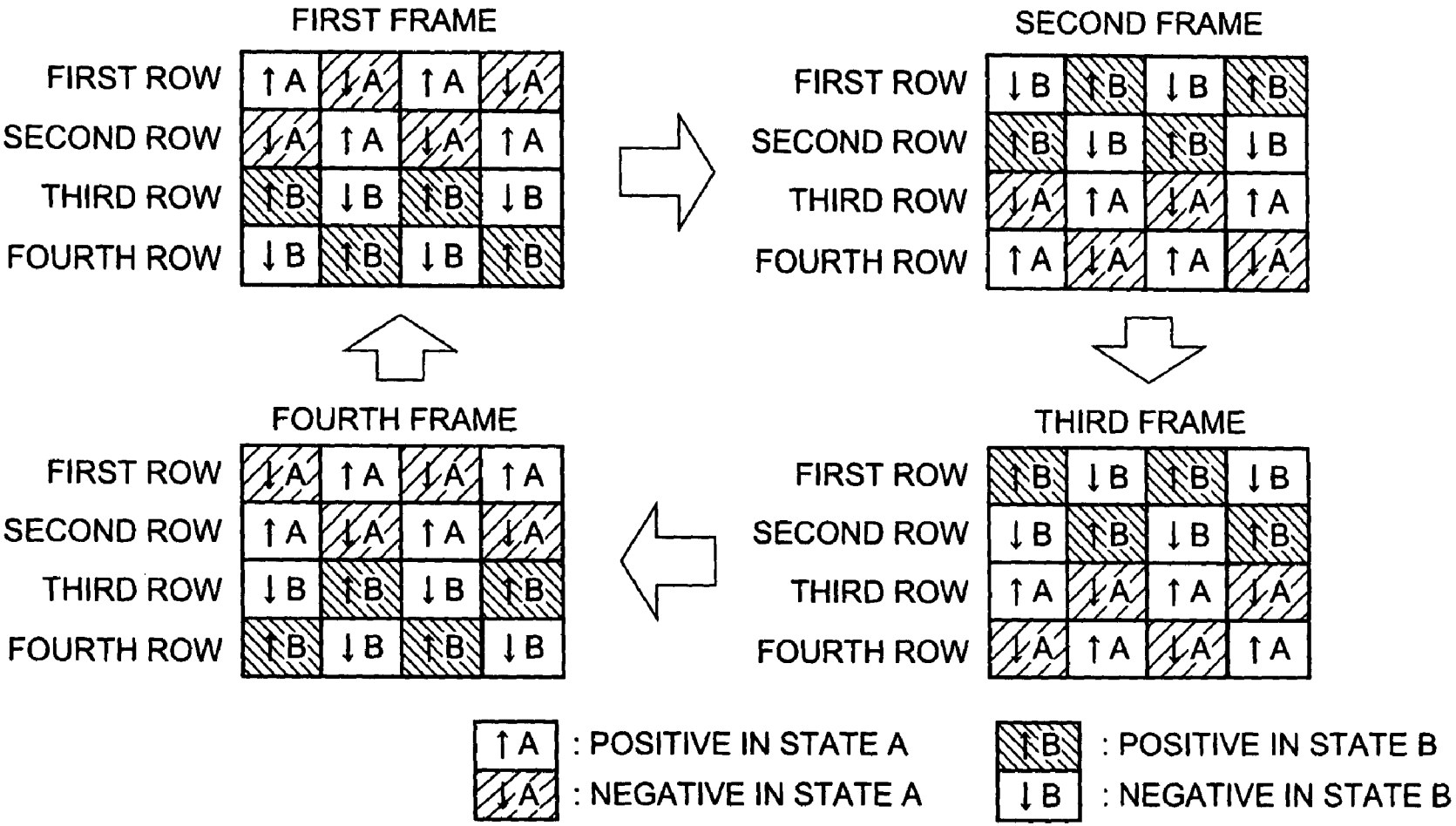
FIG. 2A is a table showing types of data signals supplied to respective pixels in the case where a 1H inversion drive method is performed while a polarity of an offset voltage of the amplifier is held during two horizontal periods and FIG. 2B is a table showing types of data signals supplied to the respective pixels in the case where a 2H inversion drive method is performed while the polarity of the offset voltage of the amplifier is held during the two horizontal periods.
Figure 2B:
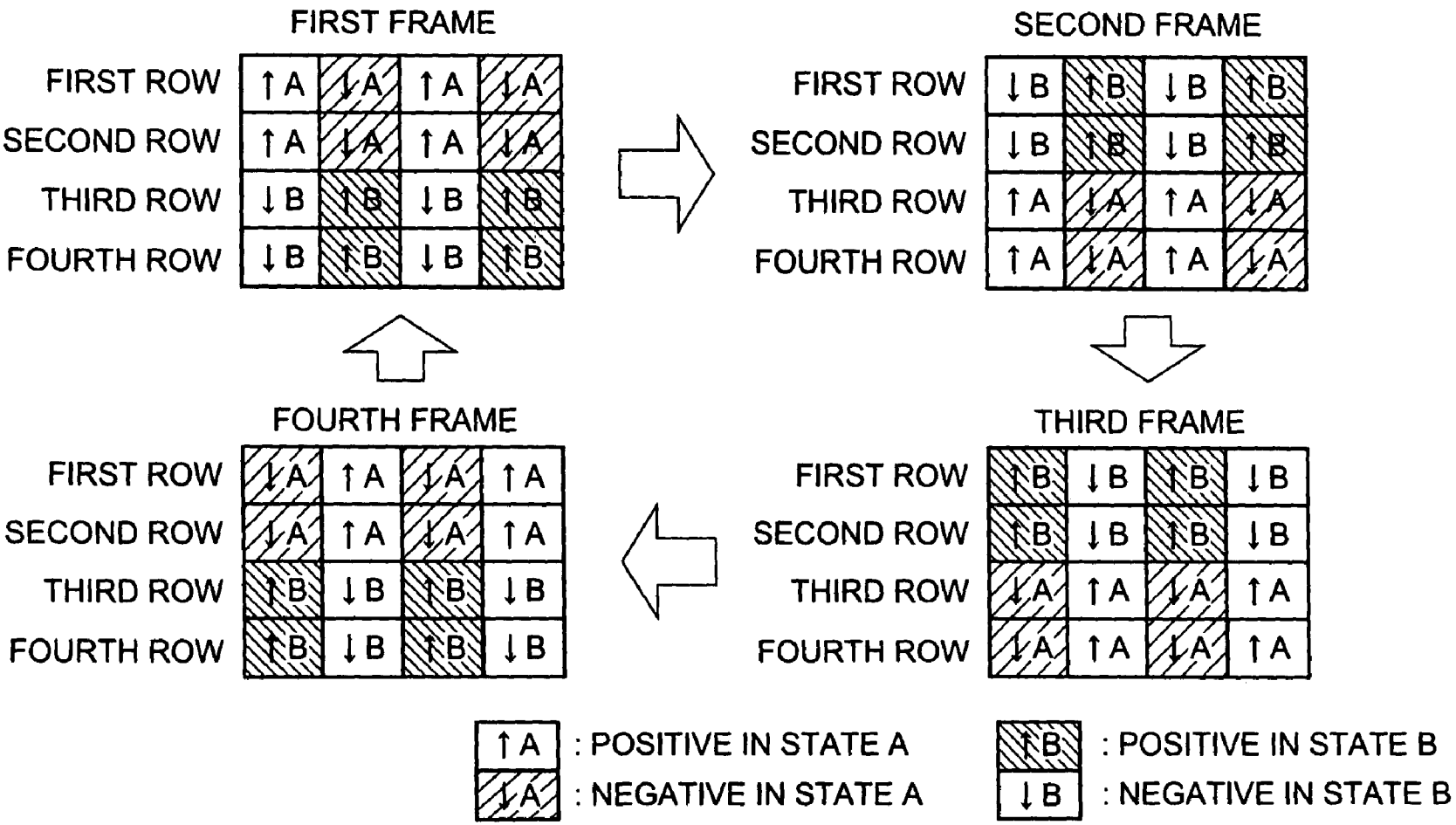
Figure 8A:
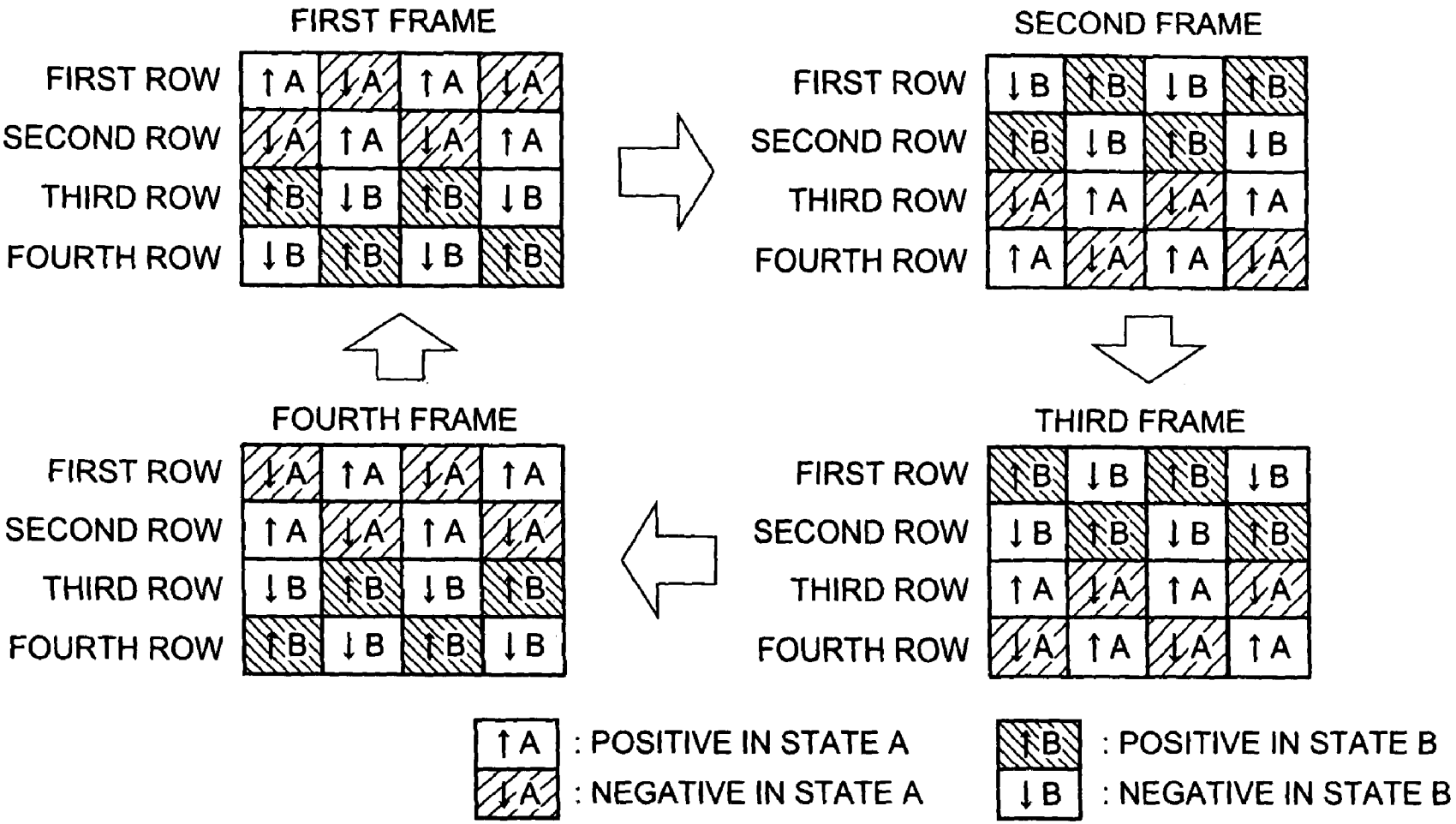
FIG. 8A shows types of data signals supplied to respective pixels in the case where an offset cancel control signal is generated as shown in FIG. 7 and the 1H inversion drive method is performed and FIG. 8B shows types of data signals supplied to the respective pixels in the case where the offset cancel control signal is generated as shown in FIG. 7 and the 2H inversion drive method is performed.
Figure 8B:
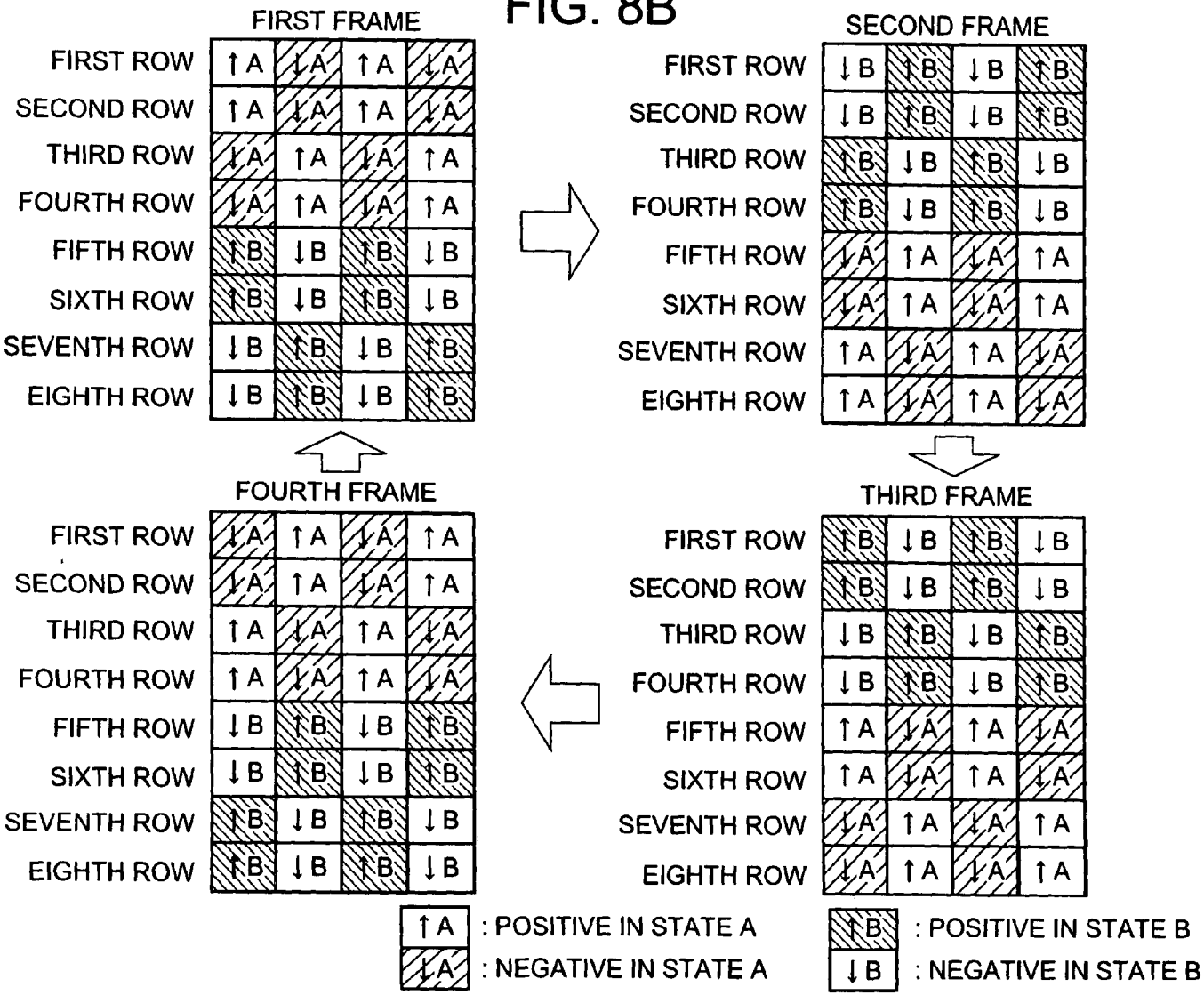

FIGS. 8A and 8B each show types of data signals supplied to the respective pixels 13 in the case where the offset cancel control signal OCC is controlled as shown in FIG. 7 and the 1H inversion drive method is performed or in the case where the 2H inversion drive method is performed. As in the cases of FIGS. 2A and 2B, symbols "↑A", "↓A", "↑B", and "↓B" used in FIGS. 8A and 8B have the following meanings.

"↑A": pixel to which data signal whose polarity is positive is supplied from output amplifier 38 having state "A" (that is, pixel to which data signal of "type 1" is supplied)

"↓A": pixel to which data signal whose polarity is negative is supplied from output amplifier 38 having state "A" (that is, pixel to which data signal of "type 2" is supplied)

"↑B": pixel to which data signal whose polarity is positive is supplied from output amplifier 38 having state "B" (that is, pixel to which data signal of "type 1" is supplied)

"↓B": pixel to which data signal whose polarity is negative is supplied from output amplifier 38 having state "B" (that is, pixel to which data signal of "type 2" is supplied)

As shown in FIG. 8A, when the 1H inversion drive method is performed, during each frame period, the polarity of the data signal is inverted for each horizontal line and the state of the output amplifier 38 (that is, the polarity of the offset voltage) is switched every two horizontal lines. On the other hand, as shown in FIG. 8B, when the 2H inversion drive method is performed, during each frame period, the polarity of the data signal is inverted every two horizontal lines and the state of the output amplifier 38 (that is, the polarity of the offset voltage) is switched every four horizontal lines. In any of the 1H inversion drive method and the 2H inversion drive method, the polarity of the data signal in the horizontal direction is inverted for each pixel (that is, during each cycle corresponding to two pixels). In addition, in any of the 1H inversion drive method and the 2H inversion drive method, the polarity of the data signal is inverted for each frame period and the polarity of the offset voltage is inverted every two frame periods.

Note that, in this embodiment, the spatial cycle at which the polarity of the offset voltage is inverted is different between the 1H inversion drive method and the 2H inversion drive method. In the 1H inversion drive method, the polarity of the offset voltage is switched every two horizontal lines. In the 2H inversion drive method, the polarity of the offset voltage is changed every four horizontal lines. Therefore, even when any of the 1H inversion drive method and the 2H inversion drive method is performed, the four types of data signals appear in a pixel column. For example, when the 1H inversion drive method is performed, the types of data signals supplied to respective pixels 13 located in the leftmost column during a first frame period are "↑A", "↓A", "↑B", and "↓B" in sequence and thus the four types of data signals appear in the pixel column. On the other hand, when the 2H inversion drive method is performed, the types of data signals supplied to the respective pixels 13 located in the leftmost column during the first frame period are "↑A", "↑A", "↓A", "↓A", "↑B", "↑B", "↓B", and "↓B" in sequence and thus the four types of data signals appear in the pixel column.

Therefore, according to this embodiment, even when any of the 1H inversion drive method and the 2H inversion drive method is performed, the four types of, data signals appear in the pixel column. The four types of data signals are supplied in a spatially uniform manner, so the image quality can be effectively improved.

The operation for the 1H inversion drive method and the 2H inversion drive method is described above. Note that the source driver 3 according to this embodiment generates the offset cancel control signal OCC based on the ½-divided signal HPOL, so the offset cancel control signal OCC can be inverted at appropriate cycles without depending on the cycle at which the polarity of the data signal is inverted. For example, when a 4H inversion drive method is performed, the polarity signal POL is inverted every four horizontal lines. Therefore, the offset cancel control signal OCC is inverted every eight horizontal lines. Thus, the four types of data signals can be expressed in the pixel column.

Figure 9:
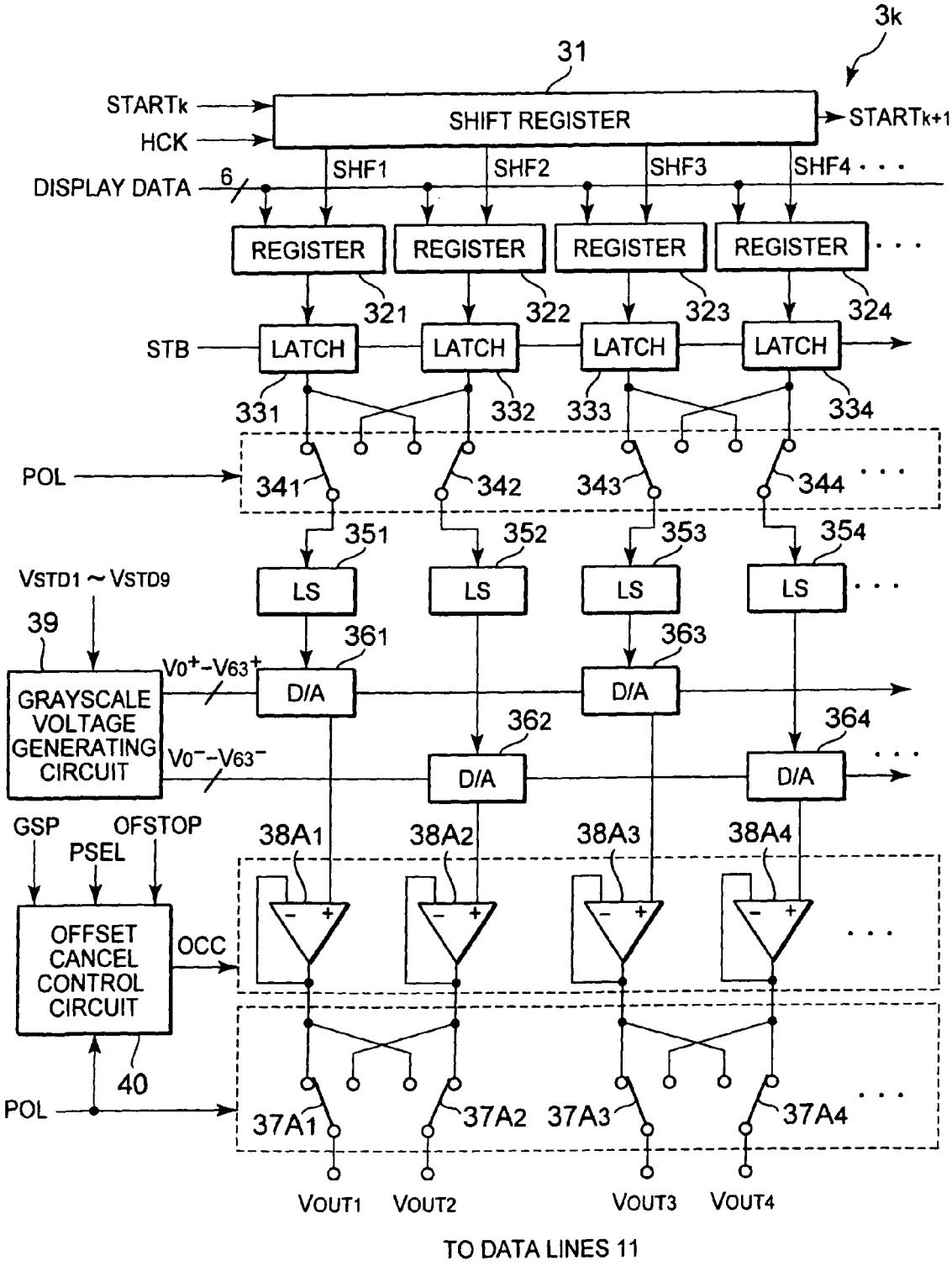
FIG. 9 is a block diagram showing another structure of the source driver according to the first embodiment of the present invention.

According to the source driver 3 shown in FIG. 4, the cross switch 37 is provided between the D/A converter 36 and the output amplifier 38. The output amplifier 38 is directly connected with the output terminal VOUTk. As shown in FIG. 9, a structure in which the output terminals of the D/A converters $\mathbf{36}_1$ to $\mathbf{36}_n$ are directly connected with output amplifiers $\mathbf{38}A_1$ to $\mathbf{38}A_n$ and cross switches $\mathbf{37}A_1$ to $\mathbf{37}A_n$ are provided between the output amplifiers $\mathbf{38}A_1$ to $\mathbf{38}A_n$ and the output terminals VOUT1 to VOUTk can be also employed. In this case, a voltage follower constructed to generate only a data signal whose polarity is positive is used as the odd-numbered output amplifier $\mathbf{38}A_{2i-1}$ and a voltage follower constructed to generate only a data signal whose polarity is negative is used as the even-numbered output amplifier $\mathbf{38}A_{2i}$. Even in such a case, the polarity of the offset voltage of each of the output amplifiers $\mathbf{38}A_1$ to $\mathbf{38}A_n$ is inverted in response to the offset cancel control signal OCC.

Second Embodiment

Figure 10:
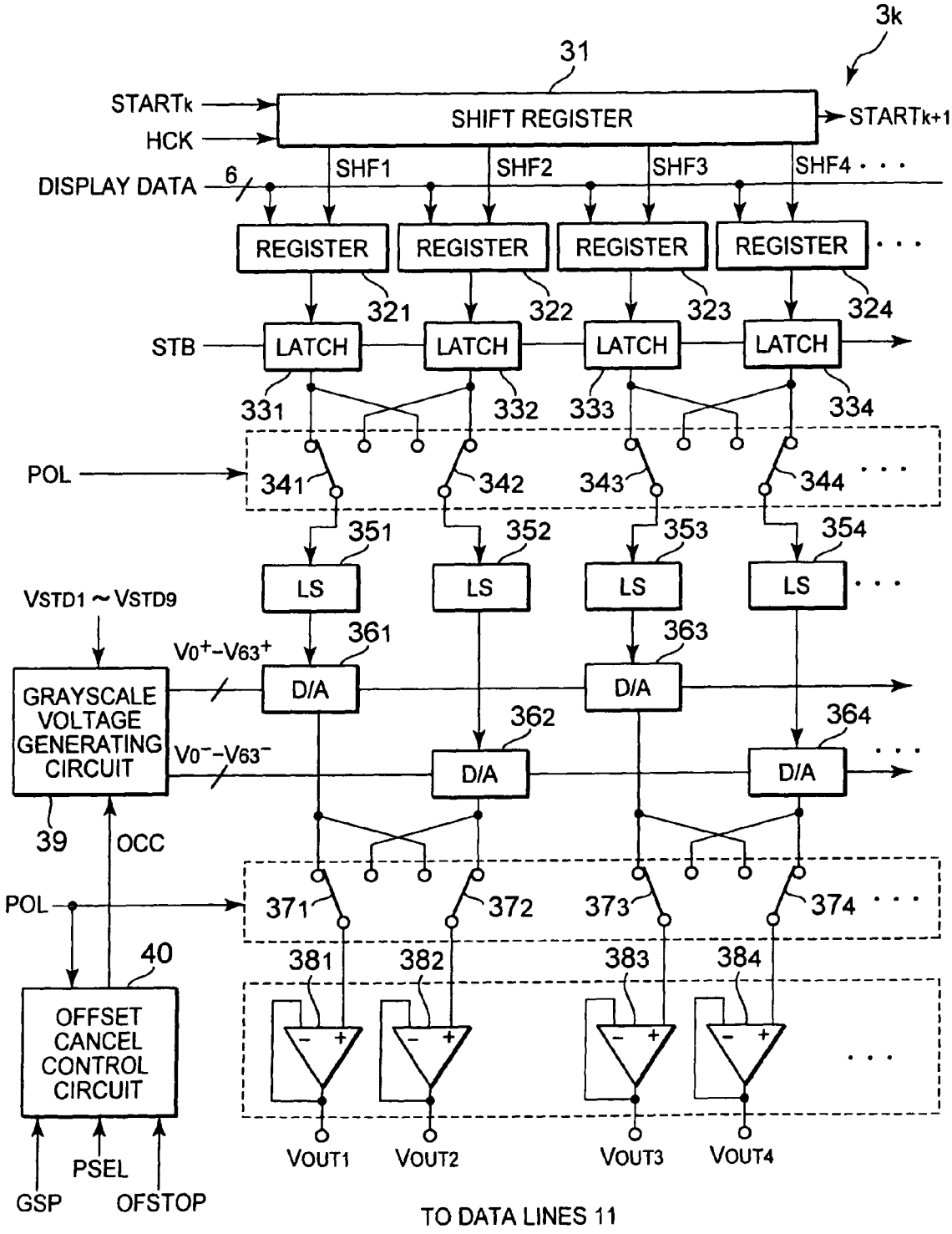
FIG. 10 is a block diagram showing a structure of a source driver according to a second embodiment of the present invention.

FIG. 10 is a block diagram showing a structure of a source driver 3 of a liquid crystal display apparatus according to a second embodiment of the present invention. In this embodiment, the polarity of the offset voltage of each of amplifiers (γ-amplifiers) used to generate grayscale voltages V0+ to V63+ and V0− to V63− by the grayscale voltage generating circuit 39 is inverted. In order to perform such an operation, the offset cancel control signal OCC is supplied to not the output amplifier 38 but the grayscale voltage generating circuit 39.

Figure 11:
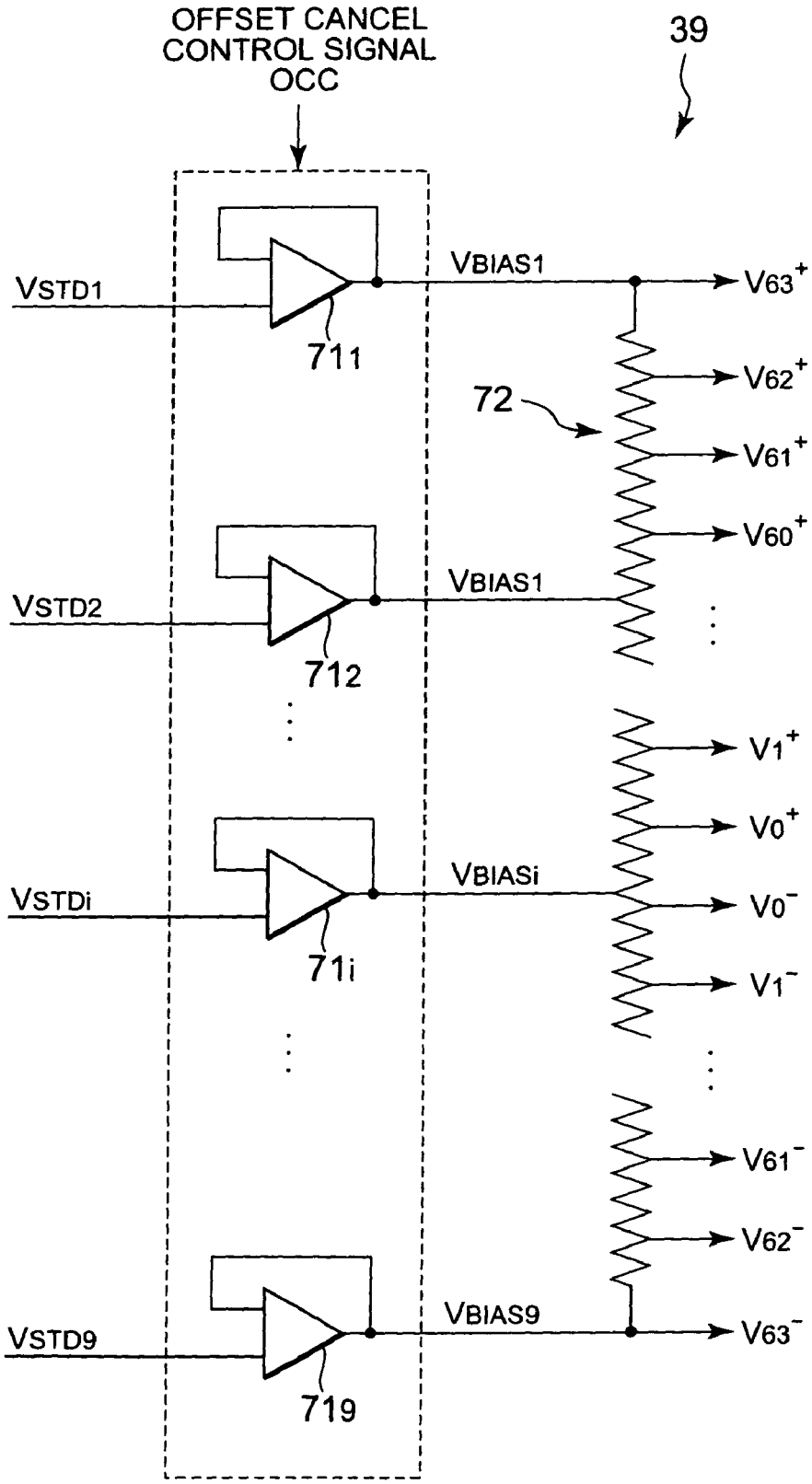
FIG. 11 is a block diagram showing a structure of a grayscale voltage generating circuit provided in the source driver according to the second embodiment of the present invention.

FIG. 11 is a circuit diagram showing a structure of the grayscale voltage generating circuit 39. The grayscale voltage generating circuit 39 includes γ-amplifiers $\mathbf{71}_1$ to $\mathbf{71}_9$ and a resistance ladder 72. The respective γ-amplifiers $\mathbf{71}_1$ to $\mathbf{71}_9$ receive the grayscale power supply voltages VSTD1 to VSTD9 from the grayscale power supply 5 and generate bias voltages VBIAS1 to VBIAS9. A voltage follower is used as each of the γ-amplifiers $\mathbf{71}_1$ to $\mathbf{71}_9$, so each of the bias voltages VBIAS1 to VBIAS9 has a voltage level equal to corresponding one of the grayscale power supply voltage VSTD1 to VSTD9 (except the offset voltages). Output terminals of the γ-amplifiers $\mathbf{71}_1$ to $\mathbf{71}_9$ are connected with respective input taps of the resistance ladder 72. The bias voltages VBIAS1 to VBIAS9 outputted from the γ-amplifiers $\mathbf{71}_1$ to $\mathbf{71}_9$ are resistance-divided to output the grayscale voltages V0+ to V63+ and V0− to V63− from the respective output taps of the resistance ladder 72.

As in the case of the output amplifier 38 in the first embodiment of the present invention, the γ-amplifiers $\mathbf{71}_1$ to $\mathbf{71}_9$ are constructed such that the polarity of the offset voltage can be inverted in response to the offset cancel control signal OCC. The amplifier having the structure as shown in FIG. 5A can be used as each of the γ-amplifiers $\mathbf{71}_1$ to $\mathbf{71}_9$.

The operation of the source driver 3 according to the second embodiment the present invention is identical to that in the first embodiment the present invention except for a point that the polarity of the offset voltage of each of not the output amplifiers 38 but the γ-amplifiers $\mathbf{71}_1$ to $\mathbf{71}_9$ is inverted. Even in the second embodiment, the offset cancel control signal OCC is generated based on the ½-divided signal HPOL, so the offset cancel control signal OCC is inverted at the cycle of two times the cycle at which the polarity signal POL is inverted. To be specific, when the 1H inversion drive method is performed, the offset cancel control signal OCC is inverted every two horizontal lines during each frame period. When the 2H inversion drive method is performed, the offset cancel control signal OCC is inverted every four horizontal lines during each frame period. Therefore, the polarity of the offset voltage of the γ-amplifier 71 is inverted at a suitable cycle corresponding to the cycle at which the polarity of the data signal is inverted. According to such an operation, deviations of the grayscale voltages V0+ to V63+ and V0− to V63− from target values, which are caused by the offset voltages of the γ-amplifiers $\mathbf{71}_1$ to $\mathbf{71}_9$ can be spatially averaged to effectively improve the image quality.

In this embodiment, only the polarity of the offset voltage of not the output amplifier 38 but the γ-amplifier 71 is inverted. When the offset cancel control signal OCC is supplied to each of the output amplifier 38 and the γ-amplifier 71, the polarity of the offset voltage of each of the output amplifier 38 and the γ-amplifier 71 can be inverted.

What is claimed is:

1. A display apparatus, comprising:

a display panel including a data line; and a source driver coupled to said display panel to supply a data signal to the data line, said data signal having a polarity determined based on a polarity signal, wherein the source driver includes:

a control circuit; and an amplifier used to generate the data signal with an offset voltage, which is constructed to invert a polarity of said offset voltage based on an offset cancel control signal from said control circuit, wherein the control circuit generates the offset cancel control signal based on the polarity signal and a gate start pulse signal, and wherein the gate start pulse signal indicates a start of a frame period to invert the offset cancel control signal every predetermined number of frame periods.

2. A display apparatus according to claim 1, wherein the source driver further includes a D/A (Digital to Analog) converter supplied with a set of grayscale voltages to select and output one of said grayscale voltages based on display data, and wherein the amplifier includes an output amplifier to generate the data signal based on the selected grayscale voltage.

3. A display apparatus according to claim 2, wherein the control circuit includes a divider circuit responsive to the polarity signal to generate a ½-divided signal, and wherein the offset cancel control signal is responsive to the ½-divided signal.

4. A display apparatus according to claim 3, further comprising a gate driver coupled to said display panel to scan gate lines thereof in response to the gate start pulse signal, wherein the control circuit generates the offset cancel control signal based on the ½-divided signal and the gate start pulse signal.

5. A display apparatus according to claim 4, wherein the control circuit further includes a ¼-divider circuit responsive to the gate start pulse signal to generate a ¼-divided signal, and wherein the control circuit generates the offset cancel control signal based on the ½-divided signal and the ¼-divided signal.

6. A display apparatus according to claim 1, wherein the source driver further includes:

a grayscale voltage generating circuit for generating a set of grayscale voltages;

a D/A converter supplied with said grayscale voltages to select one of said grayscale voltages based on display data; and an output amplifier responsive to said one of grayscale voltages from the D/A converter to generate the data signal; and the amplifier includes a γ-amplifier which is integrated in the grayscale voltage generating circuit and used to generate the set of grayscale voltages.

7. A display apparatus according to claim 1, wherein:

the source driver further includes:

a grayscale voltage generating circuit for generating a set of grayscale voltages;

a D/A converter supplied with said set of grayscale voltages to select one of grayscale voltages based on display data;

an output amplifier responsive to said grayscale voltage from the D/A converter to generate the data signal; and a γ-amplifier which is integrated in the grayscale voltage generating circuit and used to generate the set of grayscale voltages.

8. A display apparatus, comprising:

a display panel including a data line; and a source driver coupled to said panel to supply a data signal to the data line, said data signal having a polarity determined based on a polarity signal, wherein the source driver includes:

a control circuit, and an amplifier used to generate the data signal with an offset voltage, which is constructed to invert a polarity of said offset voltage based on an offset cancel control signal from said control circuit, wherein the control circuit generates the offset cancel control signal based on the polarity signal and a gate start pulse signal, the display apparatus further comprising a gate driver coupled to the panel to scan gate lines in response to the gate start pulse signal, wherein the gate driver activates the gate lines in order from one of the gate lines which is adjacent to the source driver, wherein a timing at which the gate start pulse signal is activated is synchronized with a vertical synchronization signal, and wherein the gate start pulse signal is applied to invert the polarity of the offset voltage by the source driver.

9. The display apparatus of claim 1, wherein the gate start pulse signal serves as a trigger for causing a gate driver to start a scanning of gate lines, and wherein a cycle at which a polarity of the offset voltage is inverted is controlled, by the source driver, corresponding to a cycle at which a polarity of the data signal is inverted based on the offset cancel control signal.

* * * * *